US008459503B2

(12) United States Patent
Groesbeck

(10) Patent No.: US 8,459,503 B2
(45) Date of Patent: Jun. 11, 2013

(54) TEMPERATURE CONTROLLED LIQUID DISPENSER, CONTAINERS THEREFORE, AND BAG-IN-BOX CONTAINER CONSTRUCTION

(76) Inventor: R. Clay Groesbeck, Salt Lake City, UT (US)

( * ) Notice: Subject to any disclaimer, the term of this patent is extended or adjusted under 35 U.S.C. 154(b) by 0 days.

(21) Appl. No.: 13/181,432

(22) Filed: Jul. 12, 2011

(65) Prior Publication Data

US 2011/0266287 A1 Nov. 3, 2011

Related U.S. Application Data

(63) Continuation-in-part of application No. 11/801,824, filed on May 10, 2007, now Pat. No. 7,975,879.

(51) Int. Cl.
*B65D 88/74* (2006.01)

(52) U.S. Cl.
USPC ..... 222/105; 222/146.1; 222/146.6; 220/592.01

(58) Field of Classification Search
USPC ..... 222/105, 146.1–146.6; 220/592.01
See application file for complete search history.

(56) References Cited

U.S. PATENT DOCUMENTS

| | | | | |
|---|---|---|---|---|
| 3,116,854 | A | 1/1964 | Rabb et al. | |
| 3,122,297 | A | 2/1964 | Sachs | |
| 3,280,573 | A | 10/1966 | Brown et al. | |
| 3,435,990 | A * | 4/1969 | Pike, Jr. | 222/1 |
| 4,516,692 | A | 5/1985 | Croley | |
| 4,757,920 | A | 7/1988 | Harootian et al. | |
| 4,771,918 | A * | 9/1988 | Haggart | 222/95 |
| 4,905,875 | A | 3/1990 | Straiton | |
| 5,096,092 | A | 3/1992 | Devine | |
| 5,301,601 | A | 4/1994 | Cretors | |
| 5,398,848 | A | 3/1995 | Padamsee | |
| 5,673,817 | A | 10/1997 | Mullen et al. | |
| 5,788,121 | A | 8/1998 | Sasaki et al. | |
| 5,803,317 | A | 9/1998 | Wheeler | |
| 5,915,596 | A | 6/1999 | Credle, Jr. | |
| 5,992,685 | A | 11/1999 | Credle, Jr. | |
| 6,026,988 | A | 2/2000 | Teetsel et al. | |
| 6,089,406 | A * | 7/2000 | Feldner | 222/103 |
| 6,095,372 | A | 8/2000 | Dorsey et al. | |

(Continued)

FOREIGN PATENT DOCUMENTS

| | | |
|---|---|---|
| JP | 2001174122 | 6/2001 |
| JP | 2003012092 | 1/2003 |

*Primary Examiner* — Kevin P Shaver
*Assistant Examiner* — Donnell Long
(74) *Attorney, Agent, or Firm* — Thorpe North & Western LLP

(57) ABSTRACT

A dispenser for relative rapid cooling or heating of the contents of a liquid storage container provides a receptacle for receiving the liquid storage container therein and positioning a thermal transfer portion of the liquid storage container in thermal conductive relationship with a thermal conduction pad associated with the receptacle. Thermal energy is effectively and efficiently transferred from the thermal conduction pad to the liquid in the liquid storage container. The thermal conduction pad is controlled to provide and maintain the desired temperature to the liquid. The liquid is dispensed directly from the container. Various types of containers can be used in the dispenser, with a special bag-in-box container having a inner container and outer box with thermal conduction windows in the box to provide good heat transfer between the thermal conduction pads and the inner container constituting an aspect of the invention. A special rigid container can also be used.

19 Claims, 25 Drawing Sheets

U.S. PATENT DOCUMENTS

| | | | | |
|---|---|---|---|---|
| 6,143,258 | A | 11/2000 | Tamura et al. | |
| 6,170,715 | B1 * | 1/2001 | Evans | 222/340 |
| 6,223,944 | B1 | 5/2001 | Gehl et al. | |
| 6,223,981 | B1 | 5/2001 | Gunder | |
| 6,497,343 | B1 * | 12/2002 | Teetsel, III | 222/1 |
| 6,550,645 | B2 | 4/2003 | Nelson et al. | |
| 6,637,646 | B1 | 10/2003 | Muise et al. | |
| 6,926,170 | B2 | 8/2005 | Groesbeck | |
| 6,938,801 | B1 | 9/2005 | Reddy et al. | |
| 7,021,206 | B2 | 4/2006 | Eckenhausen | |
| 7,021,496 | B2 | 4/2006 | Almond | |
| 7,076,966 | B2 | 7/2006 | Mullen | |
| 7,137,538 | B2 * | 11/2006 | Wright | 222/541.6 |
| 7,165,700 | B2 | 1/2007 | Macler et al. | |
| 7,188,749 | B2 | 3/2007 | Miller et al. | |
| 7,373,784 | B2 | 5/2008 | Haskayne | |
| 7,464,567 | B1 * | 12/2008 | Crossley et al. | 62/457.8 |
| 7,654,191 | B2 | 2/2010 | Greenwald et al. | |
| 7,975,879 | B2 | 7/2011 | Groesbeck | |
| 2002/0050496 | A1 | 5/2002 | Van Der Meer et al. | |
| 2003/0102333 | A1 * | 6/2003 | Wright | 222/340 |
| 2003/0213814 | A1 | 11/2003 | Phelps et al. | |
| 2005/0023292 | A1 | 2/2005 | Market et al. | |
| 2006/0112717 | A1 | 6/2006 | Walton | |
| 2006/0175355 | A1 | 8/2006 | Glucksman et al. | |
| 2007/0045339 | A1 | 3/2007 | Manion | |
| 2011/0036864 | A1 | 2/2011 | McKenna | |

* cited by examiner

TEMPERATURE CONTROLLED LIQUID DISPENSER, CONTAINERS THEREFORE, AND BAG-IN-BOX CONTAINER CONSTRUCTION

RELATED APPLICATIONS

This is a continuation-in-part of application Ser. No. 11/801,824, filed May 10, 2007, now U.S. Pat. No. 7,975,879, incorporated herein by reference.

BACKGROUND OF THE INVENTION

1. Field

The present invention relates generally to liquid dispensers, such as water dispensers, which control the temperature of a liquid to be dispensed from the dispenser, and also relates to liquid containers to be used in such liquid dispensers. The present invention also relates to liquid containers.

2. State of the Art

There are numerous types of liquid containers such as bottles, cans, and plastic containers. Where it is desired to maintain liquid in such liquid containers at a particular temperature, the containers are usually placed in a temperature controlled space where the temperature of the container and the liquid contents of the container are allowed to equilibrate with the temperature in the temperature controlled space. For example, to keep the liquid contents of a container cool, the container is placed in a storage space which is cooled to a particular temperature, such as being placed in a refrigerator. A bottle, carton, or plastic container of milk can be placed in a refrigerator to keep the milk in the container cool. A bottle, pitcher, plastic container, or can of water or soft drink can be placed in a refrigerator to cool the drink before it is used. When placed in a controlled temperature space, such as in a refrigerator, the container is cooled and the contents of the container is cooled through the container. The speed with which the liquid in the container is cooled depends in large part upon the heat transfer properties of the container and the temperature of the temperature controlled space, such as the interior space of the refrigerator.

Liquid dispensers are common and take many forms. Portable drink containers such as insulated containers are designed to hold hot or cold liquids and to keep such liquids hot or cold for extended periods of time because the containers are made of materials with low heat conductivity. The temperature of the liquid in the container at any given time is determined by the temperature of the liquid when put into the container, how long the liquid has been in the container, the heat conductivity of the container, and the ambient temperature of the surroundings of the container. Sometimes a liquid to be cooled is placed in an insulated container with ice cubes to cool and maintain the liquid cool for an extended period. Liquid dispensers, such as plastic containers sized to fit into a refrigerator and having a dispensing valve therein, are available which sit in a refrigerator to keep the liquid contents of the dispenser cool. When it is desired to dispense the cooled liquid, the refrigerator is opened and the cool liquid is dispensed through the dispensing valve. These are similar to other plastic containers, such as plastic milk or water containers or bottles, which are placed in a refrigerator to keep the contents of the containers cool.

Some liquid dispensers, such as office water coolers, use a water container, such as a five gallon glass or plastic water bottle that is inverted on the water cooler so that water can flow by gravity from the container into the water cooler which includes a cool water reservoir into which water flows and is cooled. Some water coolers also have a hot water reservoir where, again, water flows by gravity from the water container into the hot water reservoir where it is heated. The cooled or heated water is dispensed from the respective reservoirs through valves which are operated to dispense the cooled or heated water. The reservoirs have limited capacity, such as about one and one half quart. When water is dispensed from a reservoir, additional water flows from the water container into the reservoir from which the water was dispensed, and this additional water which is at ambient temperature, heats or cools the water in the reservoir. The water then in the reservoir is heated or cooled in the reservoir over time to the desired temperature. Thus, only a limited amount of cooled or heated water of the desired temperature is available at any time. The entire water container, such as the five gallon water bottle, and its liquid contents is not cooled or heated.

Bag-in-box container systems have become widely used as packing and shipping containers for a variety of liquid products such as soft drink syrup, milk, and wine. Such systems generally include a flexible bag or bladder disposed in a cardboard box such as a corrugated cardboard box. The flexible bladder can conform to the shape of the inside of the box when filled with a liquid material. However, the bag does not provide a shape retaining container and the box is needed to provide structure and shape to the container. The box provides a fixed container shape for the bag and contents and protects the bag. It will be appreciated that the box shape of the container has particular advantages for stacking the containers and maximizes the number of containers that can be stored within a given storage space. Additionally, such bag-in-box containers are usually relatively inexpensive to make and easy to produce and assemble. Therefore, the bag-in-box container is usually disposable and is disposed of after use rather than being saved and refilled. Bag-in-box containers come in various sizes, with many such containers having a five gallon capacity similar to the five gallon office water cooler bottles, two and one half gallon sizes are common, with bag-in-box wine containers generally having about a five liter capacity (about one and one-quarter to one and one-half gallon) capacity.

Sometimes products stored, transported, and dispensed from bag-in-box containers need to be cooled and maintained in cooled condition. For example, bag-in-box containers of milk are stored and transported in a refrigerated space and the dispenser for the milk from the bag-in-box containers includes a refrigerated space to hold and refrigerate the box with the bag therein. The cool of the refrigerated space penetrates through the box and cools the bag and the milk therein. These bag-in-box milk containers are constantly maintained in a cooled condition from filling to dispensing so that the milk is maintained and is dispensed from the bag-in-box container in cooled condition. However, with bag-in-box containers, the cardboard forming the box for the bag-in-box containers generally has poor heat conduction properties so provides relatively poor heat conduction between the bag and the environment outside the box. This is not a problem where the containers are continuously maintained in a refrigerated environment, and can even be an advantage in slowing warming of the contents of the container if the container is temporarily removed from the refrigerated environment. But, if the bag-in-box container is stored at ambient temperature and it is desired to cool the contents of the bag-in-box container prior to use, the bag-in-box container has to be placed in a refrigerated environment for a period of time prior to use sufficient to allow cooling of the contents through the box. For example, bag-in-box wine containers can be stored and transported at ambient temperature. Where the wine is desired to be cooled prior to serving, the bag-in-box wine container is placed in a refrigerator for a time period prior to serving sufficient to cool the wine through the box. Planning is needed to place the bag-in-box container in the refrigerator enough time prior to serving to allow it to cool sufficiently. Again, once the wine in the bag-in-box container is cool, the cardboard box holding the bag provides insulation to keep the wine cool for a period of use with the container out of the refrigerator.

Water is sometimes packaged in a bag-in-box container as shown in my U.S. Pat. No. 6,926,170. As shown in that patent, the water is stored and used at ambient temperature. The water from the bag-in-box container is pumped from the bag-in-box container to a drink machine using water, or to a water cooling or a water heating system when it is desired to supply either cold or hot water. The water cooling or water heating system may be similar to water cooling and heating systems used in the usual office water cooler using inverted five gallon bottles of water as the water supply as described above. With such systems, only a small portion of water from the bag-in-box water supply is cooled at any one time in a water cooling reservoir. As cooled water is used, ambient temperature water is pumped to the cooling reservoir from the bag-in-box water supply. The amount of cooled water available at any one time is limited to somewhat less than the capacity of the cooling system reservoir as ambient temperature water is added to the cooled water in the reservoir as the cooled water is dispensed. U.S. Pat. No. 6,143,258 shows a water dispenser, again similar to a water dispenser using a five gallon bottled water supply, but which uses a bag-in-box water supply rather than a bottled water supply. The water dispenser of this U.S. Pat. No. 6,143,258 similarly has a reservoir for cooled water and a reservoir for hot water. Water flows by gravity from the bag-in-box supply at ambient temperature into the cool water reservoir to be cooled or into the hot water reservoir to be heated. Again, as with the standard five gallon bottle water coolers, only a small portion of water from the bag-in-box water supply is cooled at any one time in the water cooling reservoir. As cooled water is used, ambient temperature water flows by gravity to the cooling reservoir from the bag-in-box water supply. If it is desired to cool and have available the entire supply of water in a bag-in-box container of water, it is necessary to place the bag-in-box water container in a refrigerator for a time period sufficient to cool the water therein. This can be a slow process because the cooling has to take place through the box of the bag-in-box container. Relatively fast cooling of the water is not achieved.

Even where a liquid container such as a plastic container forming a liquid dispenser is placed in a refrigerator, or a glass or plastic bottle such as a gallon milk container or other drink container is placed in a cooled location, such as in a refrigerator, significant time is required for heat to be transferred from the liquid in the container, through the container, to the cooled air in the refrigerator.

SUMMARY OF THE INVENTION

According to the invention, a dispenser for relative rapid cooling or heating of the contents of a liquid storage container of predetermined size and shape provides a receptacle for receiving the liquid storage container therein and positioning a thermal transfer portion of the liquid storage container in thermal conductive relationship with a thermal conduction pad associated with the receptacle. In one embodiment of the dispenser, the thermal conduction pad includes a cooling or heating surface adapted to contact a portion of the receptacle in thermal conductive relationship. The portion of the receptacle in thermal conductive relationship with the thermal conduction pad has good thermal conductive properties. The liquid storage container received in the receptacle is positioned in the receptacle with the thermal transfer portion of the container in thermal conductive contact with the portion of the receptacle in thermal conductive contact with the thermal conduction pad. In this way, thermal energy is effectively and efficiently transferred from the thermal conduction pad, through the receptacle and the thermal transfer portion of the liquid storage container, to the liquid in the liquid storage container. The thermal conduction pad has a high heat capacity so can absorb or give off more heat per unit time than does air, thus providing faster cooling or heating of the liquid in the container than does cool air surrounding the container, such as in a refrigerator, or hot air surrounding the container in a hot air environment, even with circulation of the cool or hot air around the container.

Various types of containers can be used in conjunction with the dispenser, such as substantially rigid containers made of plastic or other materials, semi-rigid containers, flexible containers, or semi-rigid or flexible containers in shape retaining packaging, such as bag-in-box containers. With the dispenser of the invention, when the liquid storage container is placed in the dispenser, the dispenser can cool or heat all of the liquid in the container and maintain all of the liquid in the container at the desired temperature for immediate use. The amount of liquid available at the desired temperature at any particular time is not limited to a smaller amount of liquid transferred from the container to a cooling or a heating reservoir as with current water dispensers. Further, liquid is generally dispensed directly from the container without being transferred from the container to the smaller cooling or heating reservoirs, thereby eliminating many areas of current water dispensers that can easily become contaminated.

While various types of containers can be used, various sizes of containers can also be used. However, the receptacle of the dispenser that receives the liquid storage container therein is generally sized and shaped to receive a liquid storage container of predetermined size and shape. Thus, dispensers can be provided to receive any desired size of liquid storage container. For example, dispensers can be sized to receive five gallon liquid storage containers, dispensers can be sized to receive two and one half gallon liquid storage containers, dispensers can be sized to receive five liter storage containers, or dispensers can be sized to receive and be used with any other desired size of container.

The dispenser includes a temperature regulation unit which controls operation of the thermal conduction pad and maintains the thermal conduction pad at a preset temperature or within a preset temperature range. This, in turn, causes heat transfer between the thermal conduction pad and the thermal transfer portion of the liquid storage container in thermal conductive contact with the thermal conduction pad to initially cool or heat the thermal transfer portion of the liquid storage container and the liquid in the liquid storage container and to then maintain the liquid in the liquid storage container at the preset temperature or within the preset temperature range. The temperature regulation unit can actually generate heat or cold in the thermal conduction pad or may control generation of heat or cold in the thermal conduction pad. For example, the temperature regulation unit can be a refrigeration unit which circulates a refrigerant through a tube in association with the thermal conduction pad which cools the thermal conduction pad. The temperature regulation unit monitors the temperature of the thermal conduction pad and supplies refrigerant as needed to maintain the thermal conduction pad at a preset cool temperature or within a preset cool temperature range. If heating is desired, the temperature regulation unit can be a heating unit which circulates a heated fluid through a tube in association with the thermal conduction pad which heats the thermal conduction pad, or can include heating coils in association with the thermal conduction pad to heat the thermal conduction pad. The temperature regulation unit monitors the temperature of the thermal conduction pad and supplies hot fluid or other heating as needed to maintain the thermal conduction pad at a preset warm or hot temperature or within a preset warm or hot temperature range.

Alternatively, the thermal conduction pad may actually convert electricity to cool, such as through the use of Peltier devices, or may generate heat, such as also through the use of Peltier devices or with resistance heating coils embedded therein, and the temperature regulation unit monitors the temperature of the thermal conduction pad and controls the electricity supplied to the thermal conduction pad to maintain its temperature at a desired preset level. Any method of cooling or heating the thermal conduction pads can be used and any method of controlling the cooling or heating of the thermal conduction pads can be used. An important feature of the dispenser of the invention is that thermal conduction pads are used in thermal conductive relationship with the liquid storage containers to provide improved and more rapid cooling and heating of the containers and liquid contained therein than would be obtained by heat transfer from the atmosphere (cooled or heated air) surrounding the container. The configuration of the receptacle receiving the liquid storage container places the container in thermal conductive relationship with the thermal conduction pad. Also, when the container is placed in the dispenser, the dispenser cools or heats substantially all of the liquid in the liquid storage container and maintains substantially all of the liquid in the liquid storage container at the desired temperature.

As indicated, various types and sizes of containers can be used in the dispenser of the invention. In one aspect of the invention, special bag-in-box containers have been found to be satisfactory liquid storage containers for use with the dispenser of the invention. A bag-in-box container of the invention includes at least one thermal conduction window disposed within the box to form the thermal transfer portion of the bag-in-box container to facilitate heat transfer through the box to the bag and contents of the bag in the box when cooling or heating of the contents is desired. This allows more rapid heat transfer from outside the box through the thermal conduction window to the contents of the box for cooling or heating the contents of the bag in the box than would normally occur through the box or through the normal construction of the box. The thermal conduction window may be a portion of the box which can be opened to directly expose the portion of the bag adjacent the window to the environment outside the box or may be an area of the box made of material having good heat transfer properties, such as an area having a thin plastic material with good heat transfer properties, rather than a corrugated material which may normally form the box. For example, the thermal conduction window may be an opening in the box covered by a thin plastic film or by a plastic, paper, or similar material which will keep the bag in the box from bulging through the opening to thereby protect the bag from damage. Such plastic, paper, or similar material may be a printed material having words and/or graphics thereon and forming a label or other box decoration. Alternately, the thermal conduction window may be an area where, if the box is made of a corrugated plastic material, the corrugated plastic material has been flattened and heat sealed or melted together to form a solid plastic material having better heat transfer properties than the corrugated plastic material forming the remainder of the box.

With the dispenser of the invention, the thermal conduction window in thermal conductive relationship with the thermal conduction pad allows good heat transfer between the cooling or heating surface of the thermal conduction pad and the contents of the bag-in-box container. This provides more rapid cooling or heating of the contents of the container than would be provided when merely placing the box with the bag therein in a cooled or heated environment or than would be provided by contact of the outside of the usual cardboard or other material forming the box with the thermal conduction surface. For example, if the thermal conduction window is an area of the box which can be opened to expose the bag, the area is opened and the box is positioned in the dispenser so that the exposed portion of the bag is positioned directly in thermal conductive contact with the cooling or heating surface of the thermal conduction pad. In some instances, the dispenser may include means, such as a pusher plate or biasing mechanism, to enhance thermal contact between the thermal conduction pad of the dispenser and the thermal conduction window of the container.

Thus, in one aspect, the invention provides a bag-in-box liquid storage container including a box having an internal storage area within an outer shell. The outer shell includes at least one thermal conduction window disposed within the outer shell to facilitate heat transfer through the outer shell to the internal storage area. An inner container, such as a flexible bladder, a semi-rigid inner container, or a substantially rigid inner container, is positioned in the internal storage area of the box to form the "bag" which contains the liquid in the box or outer shell. The inner container is positionable in thermally conductive contact with the at least one thermal conduction window in order to facilitate heat transfer between contents of the inner container and the thermal conduction window. Advantageously, the thermal conduction window in thermally conductive contact with the inner container allows the contents of the inner container to be heated or cooled without removing the inner container, or the liquid contents of the inner container, from the assembled bag-in-box storage container.

The present invention also provides a method for regulating the temperature of a liquid stored in a liquid storage container including obtaining a liquid storage container having at least one thermal transfer portion therein. The method includes placing the obtained liquid storage container in a receiving receptacle in a dispenser such that the at least one thermal transfer portion in the liquid storage container is in thermally conductive contact with at least one thermal conduction pad in the receptacle. The method then includes the step of regulating the temperature of the at least one thermal conduction pad such that the at least one thermal conduction pad conductively transfers thermal energy between the thermal conduction pad and the liquid contained in the liquid storage container through the at least one thermal transfer portion of the liquid storage container to equalize the temperature of the liquid within the container and the thermal conduction pad.

The present invention also provides a method for using a bag-in-box storage container in the above method for regulating the temperature of a liquid stored in a liquid storage container by obtaining a bag-in-box storage container having a liquid therein and having at least one thermal conduction window in the box of the bag-in-box storage container to form the thermal transfer portion of the bag-in-box liquid storage container, and placing the bag-in-box liquid storage container in the receiving receptacle of the dispenser such that the at least one thermal conduction window in the bag-in-box liquid storage container is in thermally conductive relationship with the at least one thermal conduction pad disposed in the receiving receptacle.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

In the accompanying drawings, which show the best mode currently contemplated for carrying out the invention.

DETAILED DESCRIPTION OF THE ILLUSTRATED EMBODIMENTS

Figure 1:
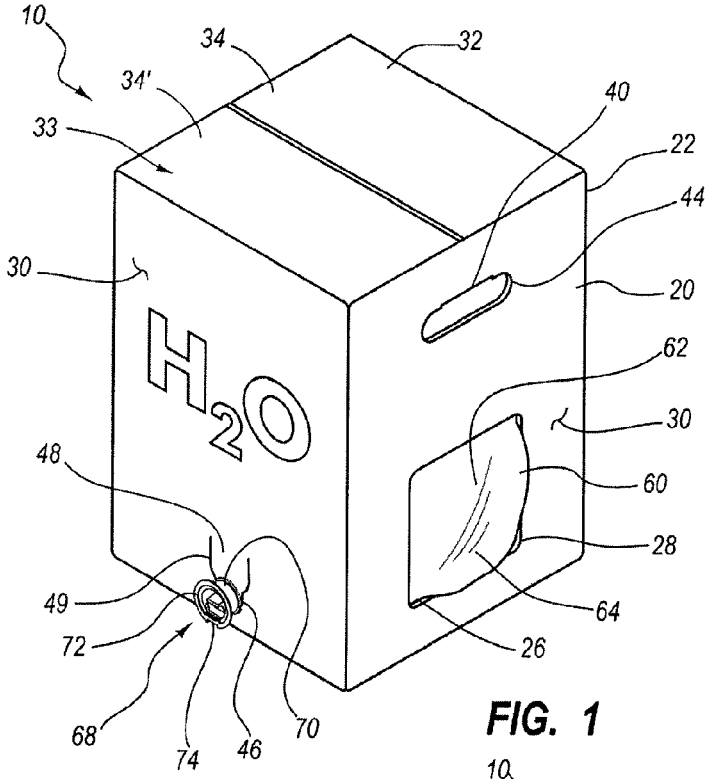
FIG. 1 is a perspective view of a bag-in-box storage container in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention provides generally a liquid dispenser for use with containers of liquid. The liquid dispenser includes a stand supporting a receptacle sized and shaped to receive a particular sized and shaped liquid storage container therein. The receptacle includes at least one thermal conduction pad positioned in the receptacle so as to be in thermal conductive relationship with the liquid storage container when the liquid storage container is placed in the receptacle. The dispenser also includes a temperature regulation unit which controls the temperature of the thermal conduction pad. Dispensing means for dispensing the liquid from the liquid storage container is usually included as a valve or spout on the liquid storage container and the dispenser provides for easy access to the dispensing means by the user.

The liquid dispenser of the present invention can be used with various types of liquid storage containers. The containers can be rigid containers made of plastic or other materials, semi-rigid containers, flexible containers, or bag-in-box containers. In one aspect of the invention, the liquid dispenser is configured to effectively cool or heat and thereafter maintain the desired temperature of a liquid packaged in a bag-in-box container and provides a unique construction of the bag-in-box container that allows for relatively rapid cooling and heating of the entire contents of the bag-in-box container. The invention will be initially described in connection with this special bag-in-box container as an example of a liquid storage container of the invention and usable in the dispenser of the invention.

A bag-in-box container includes an outer shell in the form of a box. The outer shell or box can be made from a corrugated cardboard material, other cardboard material, corrugated plastic material, or similar material. An inner container, such as a flexible bladder or bag, is disposable inside the outer shell to form the bag-in-box storage container. The inner container usually has a spout or valve through which the contents of the inner container in the box can be dispensed.

The bag-in-box container of the invention includes an outer shell or box having at least one thermal conduction window. The thermal conduction window can be a removable or a relatively thinner portion of the outer shell. The thermal conduction window is in thermally conductive contact with the inner container when the inner container is disposed in the outer shell or box. The thermally conductive contact between the thermal conduction window and the inner container allows for the transfer of thermal energy in the form of heat between the contents of the inner container and the outer shell. Heat can either be added to or extracted from the contents of the inner container through the thermal conduction window of the outer shell in order to heat or cool the contents of the inner container, as desired. The thermal conduction window forms a thermal transfer portion of the bag-in-box container.

Figure 2:
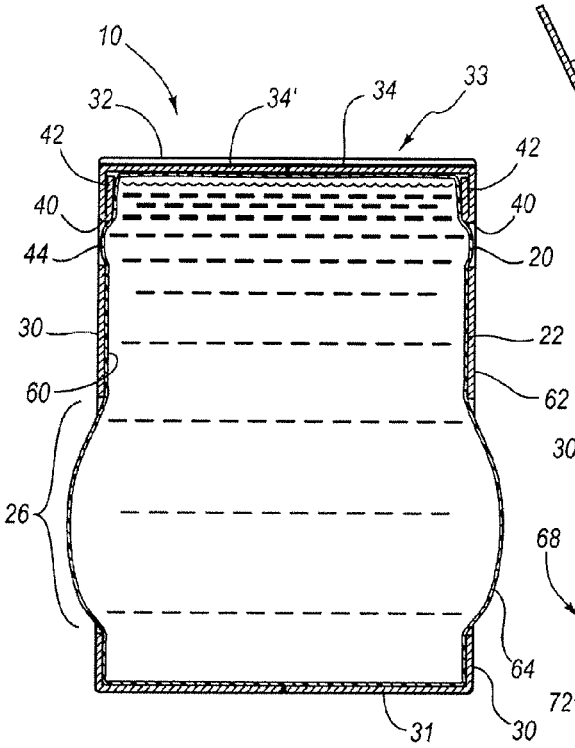
FIG. 2 is a cross sectional front view of the bag-in-box storage container of FIG. 1.
Figure 3:
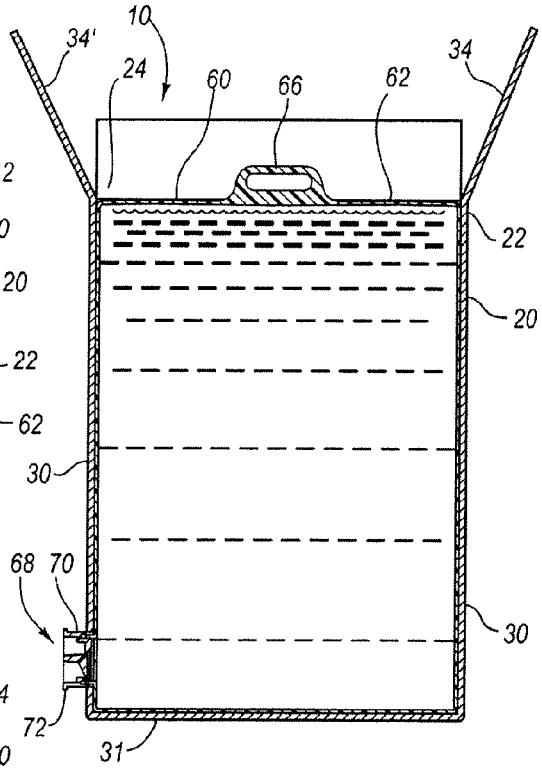
FIG. 3 is a cross sectional side view of the bag-in-box storage container of FIG. 1.

As illustrated in FIGS. 1-3, a bag-in-box liquid storage container, indicated generally at 10, in accordance with an embodiment of the present invention, is shown for use in storing liquid or aggregate materials. The storage container 10 includes a box 20 and an inner container in the form of a flexible bladder 60.

The box 20 forms the outer shell 22 that forms an internal storage area 24 within the outer shell or box. The outer shell 22 has a plurality of sides 30 and a bottom 31 that are joined together to form the box 20. The outer shell 22 also has an openable lid 32 on top 33 of box 20. The openable lid 32 has two doors or flaps 34 that can be folded to a closed position, as shown in FIGS. 1 and 2, and an open position as shown in FIG. 3. The flexible bladder 60 can be placed within the internal storage area 24 of the box 20 through the openable lid 32. The outer shell 22 can be formed from a corrugated insulation material, such as cardboard, plastic, or the like. The box 20 can have a quadrangular shape. For example, the box 20 can be rectangular or square as illustrated in FIGS. 1-3. Alternatively, the box 20 can have other shapes, such as a cylinder, triangle, or the like.

The outer shell 22 includes at least one thermal conduction window, indicated generally at 26. The thermal conduction window 26 is disposed within the outer shell 22 in order to facilitate heat transfer by conduction through the outer shell and into the internal storage area 24. In the embodiment of FIGS. 1-3, the thermal conduction window 26 is an aperture or opening 28 that extends through a side 30 of the outer shell 22. The opening 28 opens the outer shell 22 and exposes or allows access directly to the internal storage area 24 and to the flexible bladder 60 therein. Opening 28 can be formed by a panel 29, FIG. 9, that can be removed by a user from one or more portions of one or more sides 30 of box 10 in order to create the opening 28 to form the thermal conduction window 26 when a user is ready to place the box 10 in a dispenser of the invention for cooling or heating of the contents of the bag-in-box container. The panel can be formed integrally with outer shell 22 and removable from a portion of the outer shell to create the thermal conduction window opening 28 such as by folding panel 29 out of the window into the internal storage area 24 or completely removing panel 29 from the box. In one embodiment, the outer shell 22 can be constructed of corrugated cardboard or other materials and at least one side 30 can include top and bottom thermal conduction window perforations 35 and a thermal conduction window center perforation 36, FIG. 9, that can be broken and separated by a user to form panel flaps 37 that can be folded into the box 10 to form box reinforcements. The flaps 37 can easily be bent and folded along lines 38 extending between the ends of the top and bottom thermal conduction window perforations 35 when the top and bottom perforations 35 and the center perforation 36 are separated or broken to form hinges for the flaps 37 along lines 38 where the flaps remain connected to box sides 30. Flaps 37 are folded into the box to remove them from and to open thermal conduction window 26. Alternately, perforations can be provided completely around the entire thermal conduction window 26, i.e., along top and bottom perforations 35 and along the lines 38 between the ends of the top and bottom perforations 35 so that the panel 29 can be separated from and completely removed by a user from side 30 to form the thermal conduction window 26.

The outer shell 22 also has a pair of handles 40. The handles 40 are formed by flaps 42 which are formed by perforations in a pair of opposite sides 30 of the outer shell 22 that can be pushed into the internal storage area 24 and folded over to create the handles 40, see FIG. 2. When the flap 42 is in the folded position, a small opening 44 is created in the outer shell 22 to create the handle. A user can insert his or her hand into opening 44 to lift the bag-in-box container 10.

The outer shell 22 also has a spout aperture 46. The spout aperture 46 can be formed by a flap 48 which is formed by perforations 49 through the outer shell 22. A spout 68 is usually positioned at the bottom side of the flexible bladder 60 and for transportation and storage is positioned inside internal storage area 24 adjacent flap 48. When ready for use, a user separates the perforations and either pulls flap 48 outwardly to open the aperture 46 or folds the flap 48 inwardly into the outer shell 22 to form spout aperture 46 with enough room so that the user can reach into the outer shell far enough to then pull spout 68 from the inside of the internal storage area 24 through spout aperture 46. As shown in FIG. 1, once the spout is pulled through the aperture 46, flap 48 can be pushed back toward the outer shell 22 around the spout to hold it in place. The liquid contents of the flexible bladder 60 can then be dispensed through the spout 68 without having to remove the flexible bladder 60 from the box or open the lid 34 of the box. The spout 68 will generally have a valve 74 therein so that a user can start, stop, and control flow of liquid from the bladder.

The flexible bladder 60 is disposable in the internal storage area 24 through the openable lid 34. However, this is done prior to or at filling of the bladder and the bag-in-box container full of the desired liquid is transported, stored, and supplied to the user with closed lid 34 and filled bladder 60 therein. The flexible bladder 60 is formed by a thin membrane 62 formed of one or more layers of a flexible plastic material. Currently, the plastic membrane forming the bladder for bag-in-box containers is made of a two ply plastic material with an inner layer or ply of a food grade plastic material, such as a low density polyethylene film, that will not affect the flavor of the liquid stored in the bladder and an outer layer or ply of an oxygen impervious material, such as a mylar or nylon, which will prevent oxygen and other gases from the atmosphere reaching the liquid in the bladder. Most food spoilage is caused by exposure of the food to oxygen. The thin membrane 62 is flexible and can conform to the shape of the internal storage area 24 to substantially fill the internal storage area when the flexible bladder 60 is filled with a liquid or aggregate material.

The flexible bladder 60 may also include a handle 66, FIG. 3, and a spout 68. The handle 66 is disposed on a top end of the flexible bladder 60 and can facilitate removal of the flexible bladder from the box 20 or the insertion of the flexible bladder into the box 20. The spout 68 is disposed on the flexible bladder 60 at an opposite end of the flexible bladder from the handle 66. The spout 68 includes an opening through the flexible bladder 60. Thus, the spout 68 is generally located on a bottom portion of the flexible bladder 60, and can be located adjacent to flap 48 when bladder 60 is positioned in the outer shell 22 of the box. The spout 68 may include an intermediate passage portion 70 and end valve portion 72 of larger diameter than the intermediate passage portion 70. A valve 74 is included in the end valve portion 70. The liquid contents of the flexible bladder can drain out of the flexible bladder through the spout 68 when valve 74 is opened. Valve 74 is normally in closed position, to stop flow out of the flexible bladder 60 except when opened by a user. An advantage of a bag-in-box container where the inner container or bag is a flexible bag or bladder is that when the liquid in the bag flows from the bag, the bag easily collapses and no area of vacuum is formed in the bag to interfere with dispensing of the liquid. No vents are necessary to allow air to flow into the bag as liquid flows out of the bag.

Figure 9:
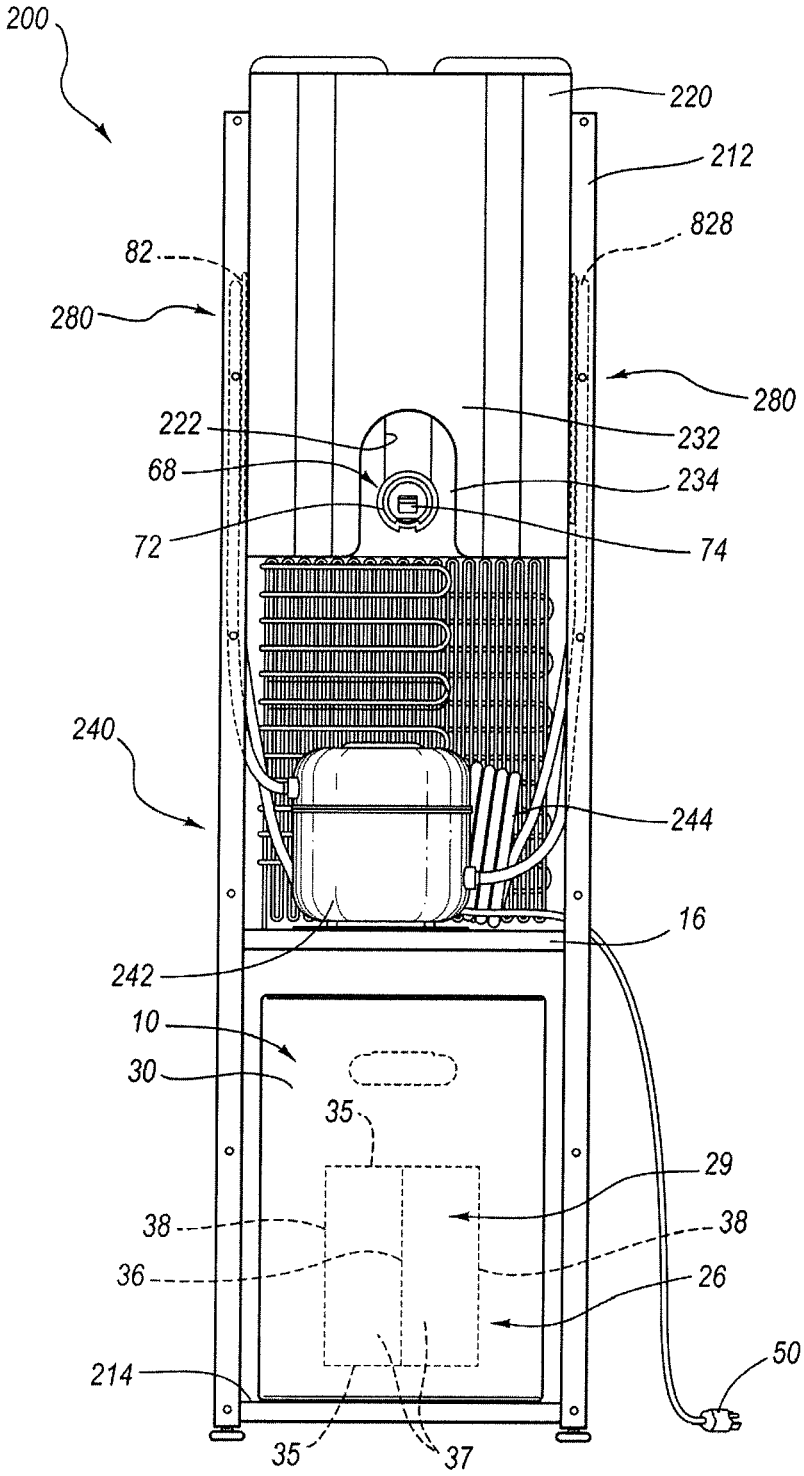
FIG. 9 is a front view of the dispenser of FIG. 8.

As the flexible bladder 60 is filled with liquid while in internal storage area 24, or as the filled flexible bladder is placed in the internal storage area 24, the thin membrane 62 is positioned adjacent the bottom 31 and sides 30 of the outer shell 22 and adjacent the at least one thermal conduction window 26. With panel 29 in place in the thermal conduction window 26, as shown in FIG. 9, the outer shell 22 forms a structurally intact closed box for easy transport and storage of the bag-in-box container. However, when the panel 29 of the thermal conduction window 26 is opened or removed, the thin membrane 62 of the flexible bladder 60 disposed in the internal storage area 24 adjacent the thermal conduction window 26 is exposed to outside the outer shell and can form a bulge or protrusion 64, FIGS. 1 and 2, extending through opening 28 of the thermal conduction window 26. The exposed portion 64 of the flexible bladder 60 can conduct thermal energy between the contents of the flexible bladder 60 and the outside of the box without interference from the insulation material of the box 20. In this way, the thermal conduction window 26 facilitates heat transfer between contents of the flexible bladder 60 and the ambient atmosphere outside the box or a thermal energy source outside the box that is in thermally conductive relationship with the portion of the flexible bladder 60 extending through the thermal conduction window.

It is a particular advantage of the present bag-in-box aspect of the invention that the thermal conduction window 26 provides a heat conduction path for cooling or heating the contents of the bag-in-box storage container 10. Specifically, the thermal conduction window provides a more direct and less insulated heat conduction path to the contents of the flexible bladder. Consequently, the conduction path advantageously allows the contents to be heated or cooled with less thermal energy, and requires less time to bring the contents to a desired temperature than a bag-in-box storage container without such thermal conduction windows.

Figure 4:
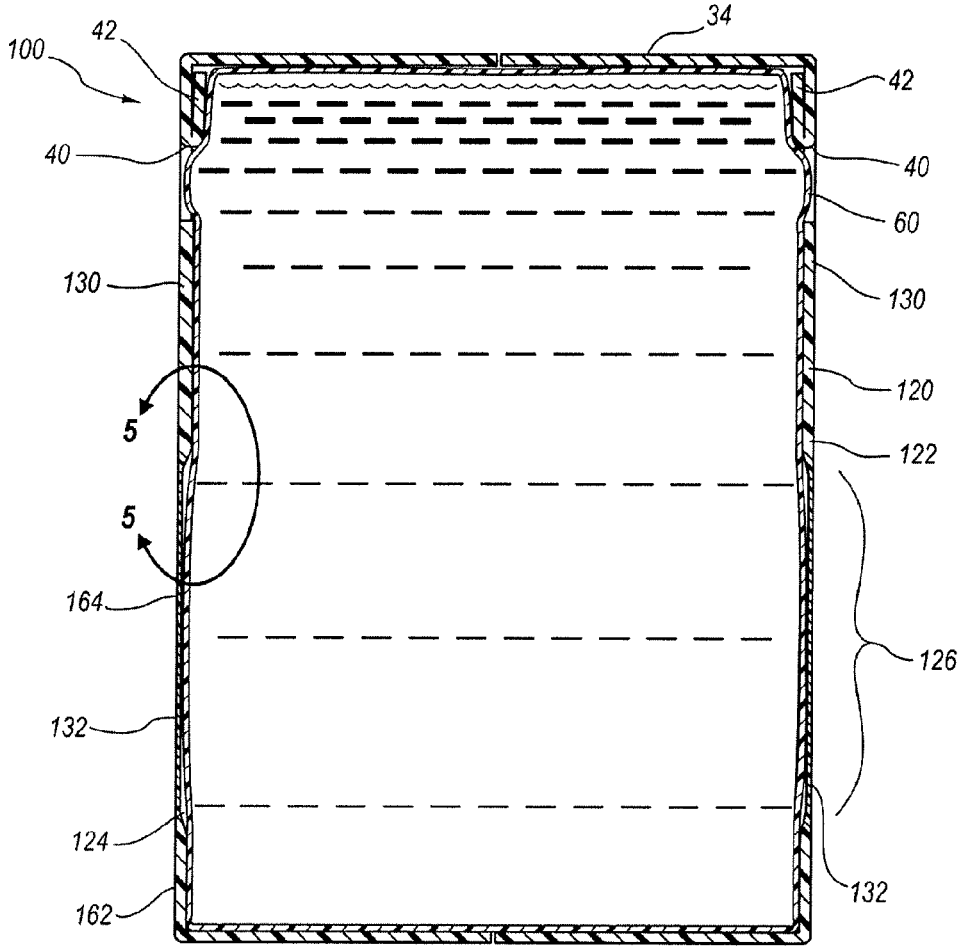
FIG. 4 is a cross sectional front view of a bag-in-box storage container in accordance with another embodiment of the present invention.
Figure 5:
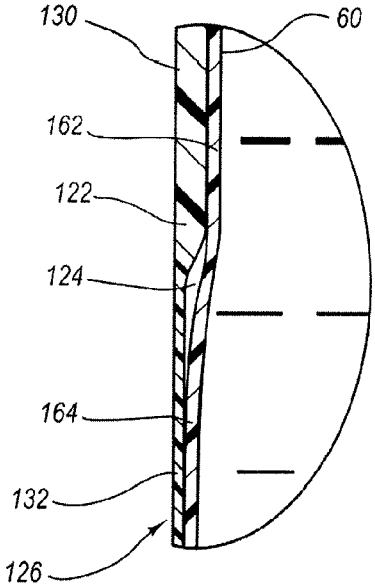
FIG. 5 is an enlarged fragmentary cross sectional front view of the portion of the bag-in-box storage container of FIG. 4 enclosed by arrow 5-5 in FIG. 4.

As illustrated in FIGS. 4 and 5, a bag-in-box storage container, indicated generally at 100, in accordance with another embodiment of the present invention, is shown for use in storing liquid or aggregate materials. The storage container 100 includes a box 120 and a flexible bladder 60. The box 120 has an outer shell 122 made from an insulative material, such as a corrugated plastic material, an openable lid 34, handles 40, and a spout aperture (not shown). Additionally, the box 120 has at least one thermal conduction window, indicated generally at 126. The thermal conduction window 126 is disposed in a side 130 of the outer shell 122 and includes a relatively thinner portion 132 of the insulative material with respect to the outer shell 122. Thus, in contrast to the storage container 10 described above, the storage container 100 does not have an opening through the outer shell 122 that forms the thermal conduction window 126, but instead has a thinned, more heat conductive portion 132 of the side wall 130 of the outer shell 122 that forms the thermal conduction window 126. It will be appreciated that thermal energy can travel through a thinner, more heat conductive portion 132 of the outer shell 122 better than through a relatively thicker, more insulative portion, and, thus, the thinner, more heat conductive portion 132 of the side wall facilitates heat transfer from outside the box 100 to the internal storage area 124 of the box, and to the bladder 60 therein and the contents of the bladder 60. When the outer shell is made from a corrugated plastic material, the thinner thermal conduction window can be formed by compressing the corrugated plastic material to get rid of the corrugations and heating the material to melt it into a solid plastic material, without the insulating properties of the corrugations, to thereby make it more heat conductive.

The thin, flexible membrane 162 of flexible bladder 60 conforms to the shape of the internal storage area when the flexible bladder is filled with a liquid or aggregate material. Thus, the flexible bladder 60 bulges slightly to form a protrusion 164 at the location of the thinner portion 132 of the side wall 130 to contact the thermal conduction window 126. In this way, the flexible bladder 60 is in thermally conductive contact with the thermal conduction window 126 and heat can transfer between the outside of the box 100 to the contents of the flexible bladder 60 through the thermal conduction window 126 and the flexible membrane 162 of the flexible bladder by conduction.

Figure 6:
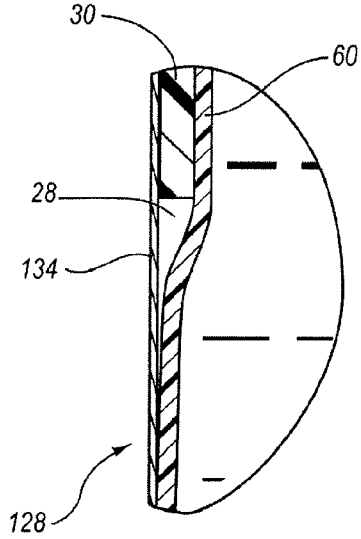
FIG. 6 is a view similar to that of FIG. 5, showing a different embodiment of the present invention.

Alternately, as shown in FIG. 6, the bag-in-box container 10 formed with openings 28 to provide the open thermally conductive window 26 as shown in the embodiment of FIGS. 1-3, can be provided with a covering material 134 with good heat conductive properties covering the open thermally conductive window 26 to prevent the bladder from bulging out of the open window as shown in FIGS. 1 and 2, which can interfere with handling the bag-in-box container during shipping and storage. Thus, the sides 30 of the bag-in-box container 10 of FIGS. 1-3 can be wrapped with a thin plastic sheet covering material or a thin paper covering material 134 that will form a membrane over the open thermal conduction window and constrain bulging of the bladder beyond the outside surface of the outer shell 22 of bag-in-box container 10. The material covering the open thermal conduction window will form a heat conductive portion of the bag-in-box container to form a covered thermal conduction window 128 similar to thermal conduction window 126 of FIGS. 4 and 5. Rather than wrapping the box 10 with the material 134, the material can be provided as pieces of material adhered to the sides 30 of the box over the open thermally conductive window 26 to form covered window 128, or can be removable pieces of material adhered to the sides 30 of the box over the open thermally conductive window 26 which can be removed to provide an open thermally conductive window 26.

In many cases it is desirable to provide a bag-in-box container with decorative graphics and labeling on the outside of the box. For example, many bag-in-box wine containers use a corrugated box which includes graphics indicating the brand, contents, and other information on the outside of the box, which may be a white or other color different from the normal corrugated box material color. When corrugated box material is used for such boxes and high quality graphics are desired, a special manufacturing process for the corrugated box material may be used. Normal corrugated box material generally includes a fluted corrugated medium with at least an inner linerboard, and usually also with an outer linerboard. In manufacturing such corrugated box material, the fluted corrugated medium, such as paperboard or containerboard, is formed into a fluted pattern and joined to a flat linerboard, such as paperboard or containerboard, to form a single face board. A second flat linerboard is joined to the other side of the corrugated medium to form what is generally referred to as single wall corrugated board. This single wall corrugated board is then used to manufacture the usual corrugated boxes. In some cases, additional layers of corrugated medium and liner can be added. Where high quality graphic printing on corrugated boxes is desired, the fluted corrugated medium is secured to a single linerboard to produce the single face board as indicated above. However, rather than joining the normal second linerboard of the usual corrugated box material linerboard, a pre-printed sheet of paperboard with high quality printing, such as lithography, is laminated (joined) to the other side of the fluted corrugated medium (the outer facing of the single face board) to form the outer linerboard. This corrugated box material is generally referred to as "Single-Face Laminate" corrugated material. It is a single wall corrugated box material with high quality printing on one side thereof.

Figure 28:
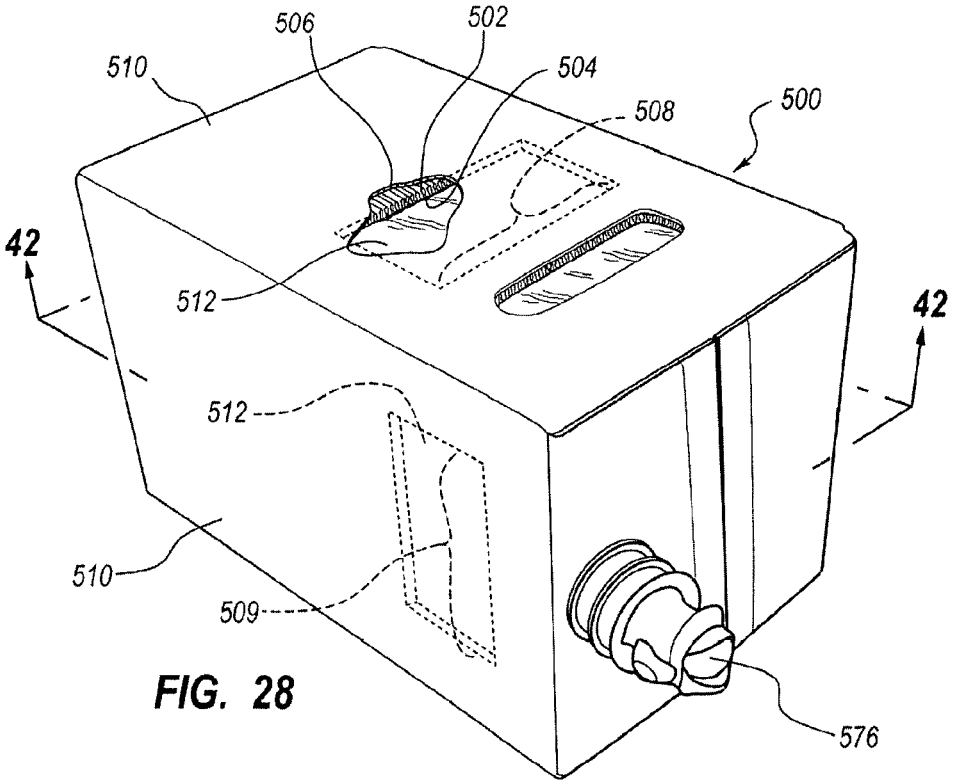
FIG. 28 is a perspective view of a further embodiment of a bag-in-box liquid storage container of the invention.
Figure 29:
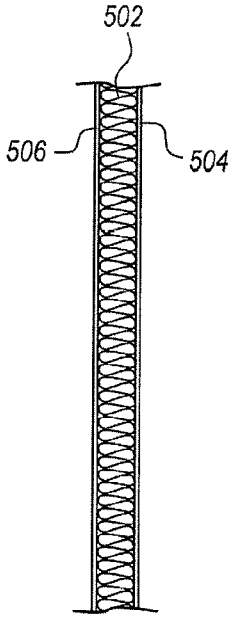
FIG. 29 is a fragmentary vertical section of the corrugated box material of the bag-in-box container of FIG. 28.
Figure 30:
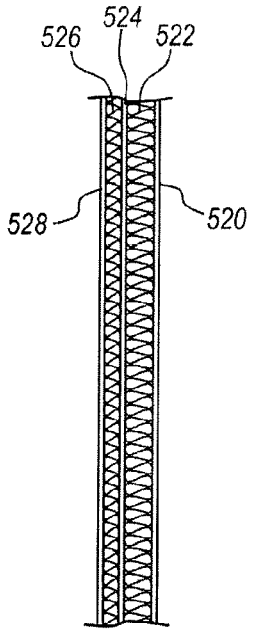
FIG. 30 is a fragmentary vertical section of an alternate corrugated box material that can be used.

A bag-in-box container 500 made of "Single-Face Laminate" corrugated material is shown in FIG. 28. The general bag-in-box container construction is similar to that of the bag-in-box container 10 of FIGS. 1-3, except that the bag-in-box container is configured for use in a different embodiment of dispenser so has a different spout location and thermal conduction window arrangement. The "Single-Face Laminate" corrugated material forming bag-in-box container 500 includes a fluted corrugated medium 502, FIGS. 28 and 29, secured to inner linerboard 504. A pre-printed sheet of paperboard 506 is laminated (secured) to the outer facing of the fluted corrugated medium 502 to form the outer surface or outer cover of the bag-in-box container 500. Thermal conduction windows 508 and 509 of the current invention, FIGS. 28 and 30, are formed in bag-in-box container sides 510 by openings 512 which extend through inner linerboard 504 and fluted corrugated medium 502. Openings 512 do not extend through outer linerboard 506 formed by the pre-printed sheet of paperboard. The pre-printed sheet of paperboard 506 forms covers for openings 512. The openings 512 can be formed through the inner linerboard 504 and fluted corrugated medium 502 during manufacture of the "Single-Face Laminate" by cutting or otherwise forming the openings 512 through the single face board consisting of the fluted corrugated medium 502 and attached inner linerboard 504 prior to attaching or laminating the pre-printed paperboard to the outer face of the single face board to form the "Single-Face Laminate" corrugated material. Referring to FIG. 6 and the preceding description of FIG. 6, the single face board, i.e., the fluted corrugated medium and first or inner linerboard, forms what is referred to as the sides 30 of the box, with the opening therethrough forming the opening 28, and the pre-printed paperboard laminated to the outer face of the single face board forms the covering material 134 covering the opening 28, to form the thermal conduction window 128. In this way, in addition to the thermal conduction window preventing the bladder from bulging out of an open window, the thermal conduction window does not disturb or interrupt the graphics on the outside of the bag-in-box container. Without the fluted corrugated material and inner linerboard, the bag in the box directly contacts the outer pre-printed sheet of paperboard which provides better heat transfer properties than the corrugated material forming the rest of the box. While the outer linerboard 506 has been described as a preprinted paperboard, similar thermal conduction windows can be made in normal corrugated box material with the usual non-printed or minimally printed outer linerboard.

Figure 31:
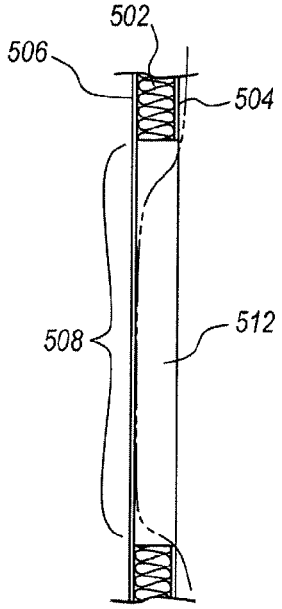
FIG. 31 is a fragmentary vertical section similar to FIG. 29 showing a thermal conduction window of the invention.
Figure 32:
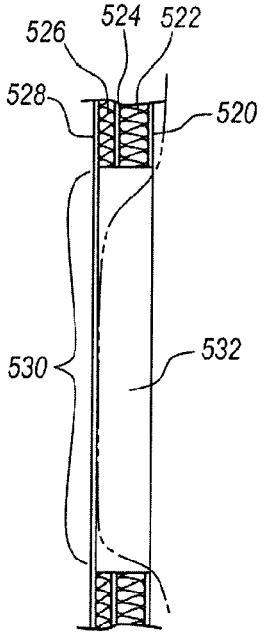
FIG. 32 is a fragmentary vertical section similar to FIG. 30 showing a thermal conduction window of the invention.

In some cases the corrugated box material may include one or more additional layers of fluted corrugated medium and liner board. For example, FIG. 31 shows corrugated box material having an inner linerboard 520, an inner fluted corrugated medium 522, an intermediate linerboard 524, an outer fluted corrugated medium 526, and an outer printed sheet of paperboard 528. This would usually be referred to as double wall corrugated box material. FIG. 32 shows thermal conduction window 530 formed in such material by an opening 532 through inner linerboard 520, inner fluted corrugated medium 522, intermediate linerboard 524, and outer fluted corrugated medium 526, but not through outer printed sheet of paperboard 528. Outer printed sheet of paperboard 528 forms a cover for the opening 532.

In some cases in connection with a bag-in-box container of the invention, the outer shell of the container, i.e., the box, may be referred to as the outer shell formed of outer shell material having and inner layer and an outer layer. When referring to corrugated box material as described above, the inner layer will include the inner linerboard and fluted corrugated medium which is cut out to form the thermal conduction window, and the outer layer will be the outer linerboard which covers the cut out material. The outer linerboard will have better heat conductive properties than the combination of the inner linerboard, fluted corrugated medium, and outer linerboard (and any additional materials such as would be present in double wall corrugated box material), or of the combination of just the inner linerboard and fluted corrugated medium.

Figure 7:
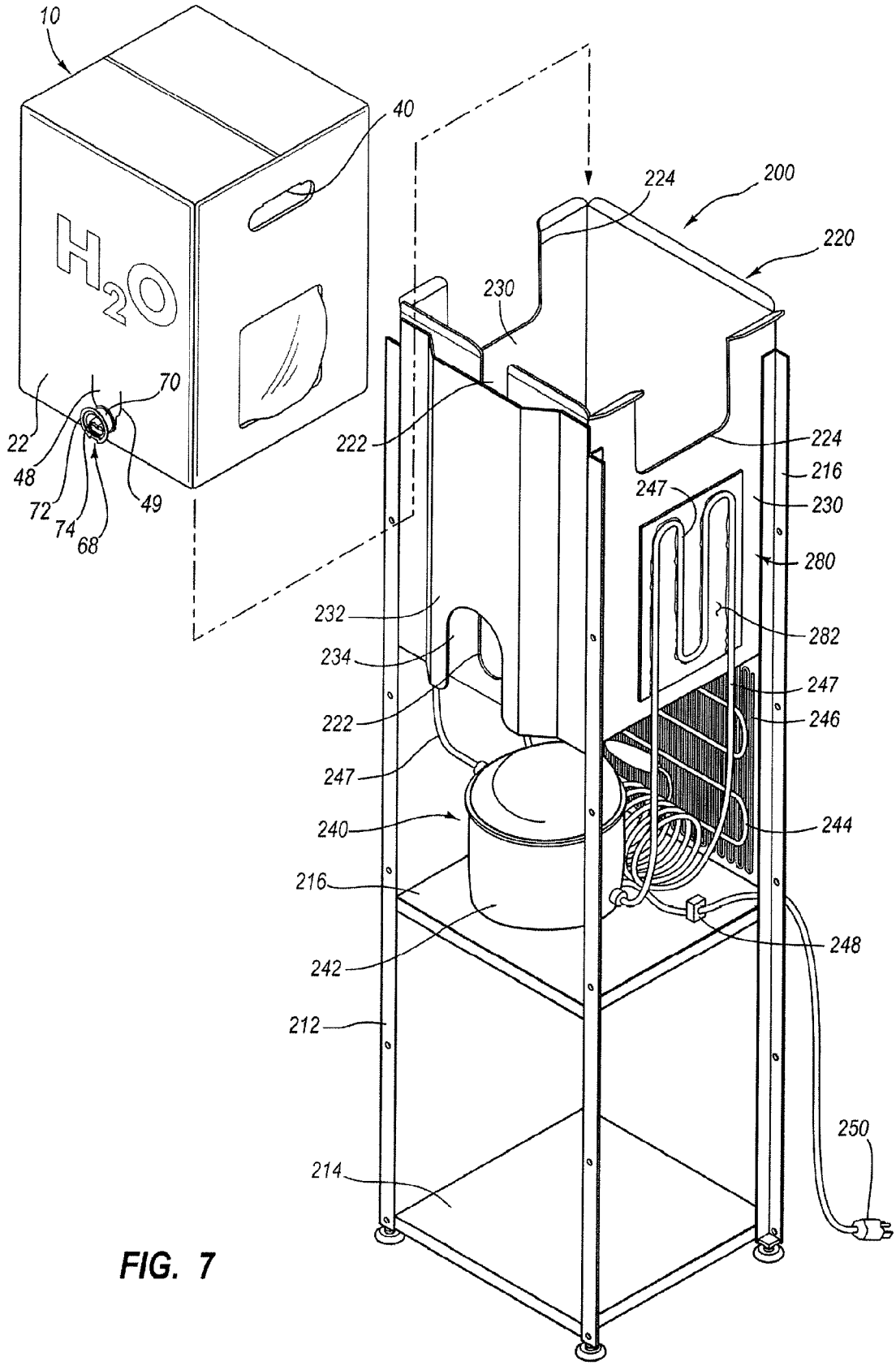
FIG. 7 is a perspective view of a dispenser in accordance with an embodiment of the present invention, shown with the bag-in-box liquid storage container of FIG. 1 ready to be placed in a receiving receptacle of the dispenser.
Figure 8:
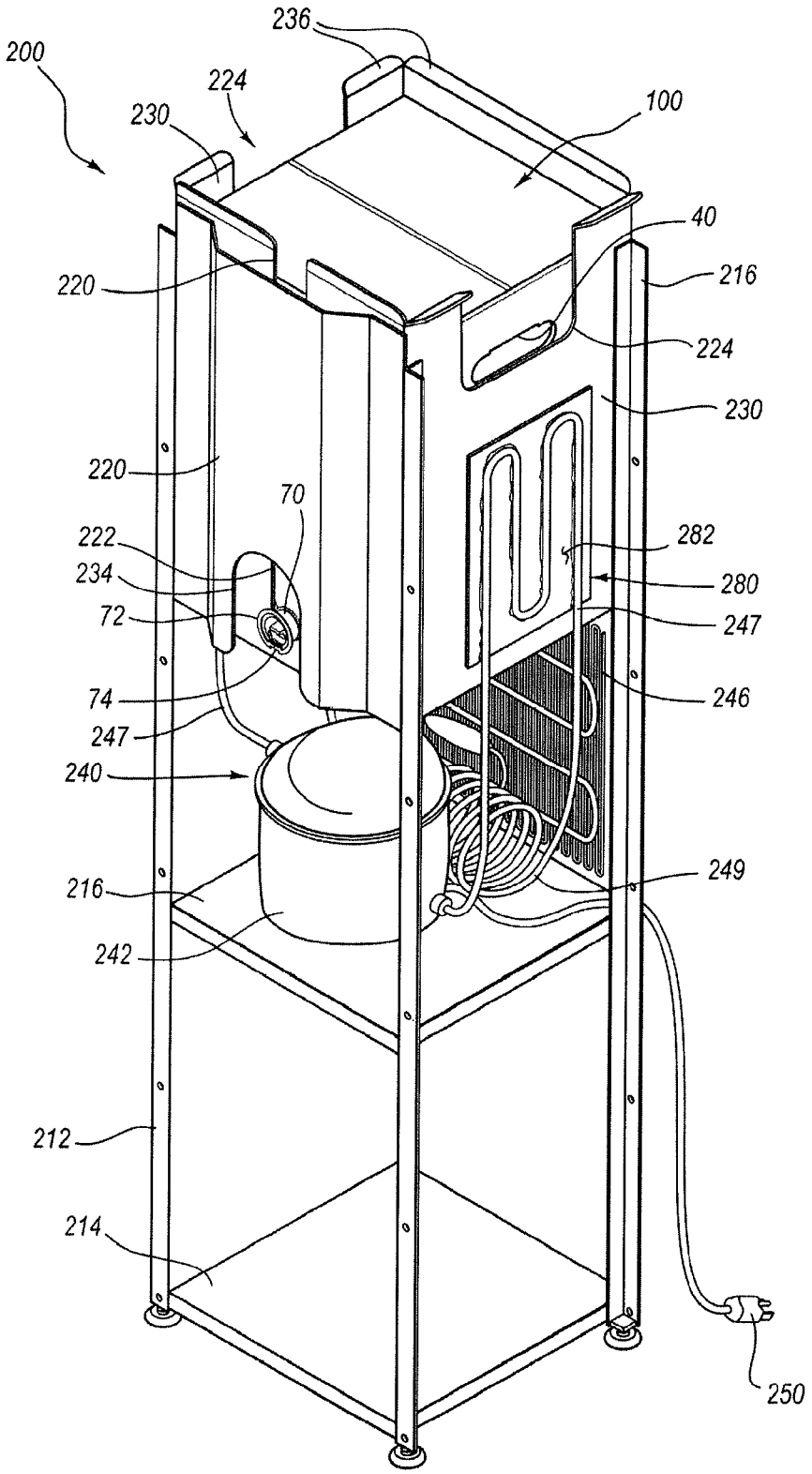
FIG. 8 is a perspective view of the dispenser of FIG. 7, shown with the bag-in-box liquid storage container of FIG. 1 placed in the receiving receptacle of the dispenser.

A dispenser of the invention for controlling the temperature of the liquid contents of a liquid storage container, such as a bag-in-box liquid storage container as shown in FIGS. 1-6, and for allowing a user to dispense the liquid contents from the liquid storage container, is indicated generally at 200 in FIGS. 7-9. The dispenser 200 includes a receptacle for receiving the liquid storage container therein, indicated generally at 220, at least one thermal conduction pad, indicated generally at 280, and a temperature regulation unit, indicated generally at 240.

The receptacle 220 for receiving the liquid storage container therein, temperature regulation unit 240, and thermal conduction pad 280 are supported and positioned by a stand 212. The stand 212 also includes a lower storage shelf 214 for storing additional liquid storage containers, such as container 10 shown on shelf 214 in FIG. 9. The stand 212 is configured to position the spout 68 of a liquid storage container, such as bag-in-box container 100, received in the receptacle 220, in a position to be accessed by a user to dispense liquid from the liquid storage container. Stand 212 positions spout 68 in an open slot 222 at the bottom of the receptacle 220 at a convenient height for dispensing liquid from the dispenser 200, and accessible to a user through opening 234.

The container receptacle 220 is disposed in an upper portion 216, FIGS. 7 and 8, of the stand 212 and is sized and shaped to receive a liquid storage container, such as either of the bag-in-box liquid storage containers 10 or 100 described above and shown in FIGS. 1-6. The container receptacle 220 includes a slot 222 sized and shaped to receive intermediate passage portion 70 of spout 68 extending from liquid storage container 10 or 100. The slot 222 has a cover 232 placed thereover in spaced relationship from the slot 222 to protect spout 68 from damage, to structurally reinforce the receptacle, and/or to make the receptacle more aesthetic. Cover 232 has a lower opening 234 therein to allow user access to the spout 68 when spout 68 is positioned in the bottom of slot 222. The liquid storage container receptacle 220 includes at least one notch 224, and preferably two oppositely positioned notches 224, that facilitates placement of the liquid storage container into the liquid storage container receptacle 220. Specifically, the notch or notches 224 allow access to the handles 40 of the liquid storage container 10 or 100 when received in the receptacle 220, FIG. 8, so that the liquid storage container can easily be lifted into or out of the receiving receptacle 220 of the dispenser 200.

The dispenser 200 includes at least one thermal conduction pad 280 positioned with respect to receptacle 220 to be in thermal conductive relationship with a liquid storage container when placed in the receptacle. The thermal conduction pad is either cooled so as to draw heat out of and thereby cool the liquid in a liquid storage container received in the receptacle or heated to provide heat to and thereby heat the liquid in the liquid storage container. In the embodiment of FIGS. 7-9, the dispenser 200 includes two thermal conduction pads 280, each coupled to an opposite sidewall 230 of the storage container receptacle 220 in a location that corresponds to a location of a thermal conduction window 26 of a liquid storage container 10 when the liquid storage container 10 is positioned in the storage container receptacle 220. If the receptacle 220 is formed of a material with good heat conductivity, such as a heat conductive metal, the thermal conduction pads can be placed, as shown, against the outside of the walls of the receptacle to transfer heat through the walls of the receptacle. In the embodiment of FIGS. 7-9, each thermal conduction pad 280 includes a thermal conduction pad plate 282, one surface of which is positioned directly against the outside surface of a sidewall 230 of the receptacle 220 so that cool or heat from the surface of the plate 282 is transferred by conduction directly to and through the receptacle sidewall 230 of the receptacle 220, from where it is transferred directly through the thermal conduction window of the liquid storage container to the contents of the container. Thus, the thermal conduction pad plates 282 provide thermal energy through receptacle sidewalls 230 to two sides of a liquid storage container 10 or 100, see FIGS. 11 and 12, when placed in receptacle 220 in order to quickly cool or heat the contents of the liquid storage container.

Figure 25:
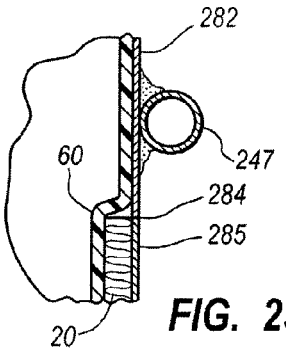
FIG. 25 is a fragmentary vertical section through a portion of a dispenser receptacle showing an alternate arrangement of the thermal conduction pad in relation to the side of the receptacle.
Figure 27:
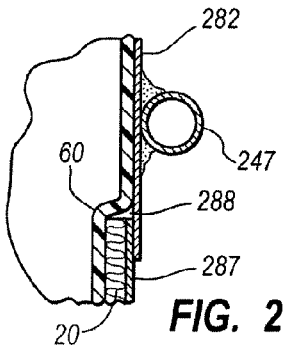
FIG. 27 is a fragmentary vertical section through a portion of a dispenser receptacle similar to that of FIG. 25 showing a still further alternate arrangement of the thermal conduction pad in relation to the side of the receptacle.
Figure 26:
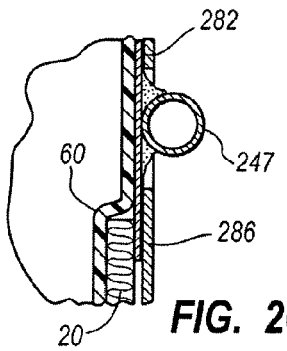
FIG. 26 is a fragmentary vertical section through a portion of a dispenser receptacle similar to that of FIG. 25 showing an further alternate arrangement of the thermal conduction pad in relation to the side of the receptacle.

If the receptacle is not made of a material with good heat conductivity, or if for other reasons heat transfer through the receptacle sidewalls is desired to be avoided, the thermal conduction pad plates 282 can be mounted with respect to the receptacle so as to be in direct thermal contact with the liquid storage container, and specifically, in direct thermal contact with the thermal conduction windows which form the thermal transfer portions of the liquid storage container. For example, the thermal conduction pad plates 282 can be mounted in the walls of the receptacle, such as in wall compartments, wall recesses, or wall cut outs 284 in receptacle sidewalls 285, see FIG. 25, or the thermal conduction pad plates 282 can be mounted on the inside surface of receptacle walls 286 of a receptacle with receptacle side walls 286, FIG. 26, so as, in either case, to directly contact the thermal conduction window or windows of the liquid storage container. As shown in FIGS. 25 and 26, the inner container or bladder 60 bulging through the thermal conduction windows in a box outer shell 22 of a bag-in-box container 10 are in direct thermal contact with thermal conduction pad plates 282. In a further alternative as shown in FIG. 27, the receptacle sidewalls 287 of a receptacle are cut out to form an opening 288 therethrough with the thermal conduction pad plate 282 mounted on the outside surface of the sidewalls 287. In such embodiment, the flexible inner container or bladder 60 extends through the opening 288 to directly contact thermal conduction pad plates 282 to provide direct thermal conduction from plates 282 to liquid container 60. This arrangement of FIG. 27 can only be effectively used with a flexible or semi-flexible (semi-rigid) container which will bulge into and through the opening 288 to contact and thus be in direct thermal contact with the thermal conduction pad plate 282.

The temperature of the thermal conduction pads is controlled by a temperature regulation unit. The temperature regulation unit controls operation of the thermal conduction pad and maintains the thermal conduction pad at a preset temperature or within a preset temperature range. The temperature regulation unit can generate the heat or cold for the thermal conduction pad or may control generation of heat or cold by the thermal conduction pad. For example, the temperature regulation unit can be a refrigeration unit which circulates a refrigerant through a tube in association with the thermal conduction pad which cools the thermal conduction pad, or the temperature regulation unit can generate heat to heat the thermal conduction pad. Alternatively, the thermal conduction pad may itself generate cool or heat such as by converting electricity to cool, such as through the use of Peltier devices, or converting electricity to heat, such as through the use of Peltier devices or the use of resistance heating coils embedded in the thermal conduction pads, and the temperature regulation unit controls the operation and temperature of the thermal conduction pads. Any method of cooling or heating the thermal conduction pads can be used and any method of controlling the cooling or heating of the thermal conduction pads can be used.

In the embodiment of FIGS. 7-9, the temperature regulation unit 240 is disposed adjacent the storage container receptacle 220. For example, the temperature regulation unit 240 can be disposed on a shelf 216 of the stand 212 below the storage container receptacle 220. The temperature regulation unit 240 produces thermal energy for regulating the temperature of the liquid storage container receptacle 220. In one aspect, the temperature regulation unit 240 can produce heat to heat the receptacle 220. In another aspect, temperature regulation unit 240 can remove heat to cool the receptacle 220. Thus, the temperature regulation unit 240 can be a refrigeration unit, a heat pump, a heater, a boiler, a chiller, or combinations of these devices.

The temperature regulation unit 240 as shown is a representation of a refrigeration unit as currently known and commercially available and used in refrigerators and includes a compressor 242 coupled to a coil 244. The coil 244 is configured to transfer heat between an ambient temperature well, such as the atmosphere surrounding the coil, and a thermally responsive fluid. The thermally responsive fluid can be refrigerant or coolant. For example, the thermally responsive fluid can be a halomethane such as chlorofluorocarbon (CFC) compound. The thermally responsive fluid can receive thermal energy from thermal regulation unit 240 and transfer the thermal energy to or from the conduction pads 280. The temperature regulation unit 240 can also include cooling fins 246 that facilitate transfer of thermal energy from the thermally responsive fluid and the surrounding atmosphere. The thermally responsive fluid, which, with a refrigeration unit as the thermal regulation unit as shown, is a cooled refrigerant, is circulated from the thermal regulation unit to the thermal conduction pads 280 through coolant tubing 247 secured in heat transfer relationship to thermal conduction pad plate 282 where it cools thermal conduction pad plate 282. This in turn cools the portion of receptacle sidewall 230 which is positioned against thermal conduction plate 282 to then cool a fluid storage container received in the receptacle and the fluid contained in the container.

While the temperature regulation unit 240 as shown in FIGS. 7-9 is indicated as a representation of a refrigeration unit, such temperature regulation unit 240 can as easily be a representation of a heating unit which produces a heating fluid which is circulated through tubing 247 to heat thermal conduction pad plate 282 and, in turn, heat the portion of receptacle sidewall 230 which is positioned against thermal conduction plate 282 to then heat a fluid storage container received in the receptacle and the fluid contained in the container.

The temperature regulation unit can include a thermostat controlled switch 248, shown schematically in FIG. 7, to control the power to the cooling unit or to the heating unit in response to the temperature of the thermal conduction pad. The switch 248 can be located in any desired position and operates to selectively control the temperature of the thermal conduction pads and the thermal energy produced by the temperature regulation unit 240. Thus, the thermostat and switch 248 can be set to cool or heat the receptacle 220 to a temperature suitable for the contents of a liquid storage container disposed within the storage container receptacle. The temperature regulation unit 220 will be connected to an electrical power supply. The electrical power supply can be a battery (not shown) or an electrical wall plug 250 that can be plugged into an electrical wall socket.

In use, when it is desired to be able to dispense a liquid from a liquid storage container and to be able to control the temperature of the liquid to be dispensed, the user obtains a liquid dispenser of the invention and obtains a container of the liquid desired to be dispensed and adapted to fit the particular dispenser to be used. For example, if the user has obtained a liquid dispenser 200 as shown in FIGS. 7-9, the user would then obtain a liquid storage container sized to fit the receptacle 220 of that particular dispenser. As shown in FIG. 7, the user can obtain a bag-in-box container 10. As shown in FIG. 9, the user could obtain the bag-in-box container 10 from the lower storage shelf 214 of the dispenser 200. With the bag-in-box container from the storage shelf 214 of the dispenser of FIG. 9, or from any other storage area, the user would open the thermal conduction window 26 by breaking the perforations 35 and 36 to fold the flaps 37 into the box or by breaking the perforations 35, 36, and 38 to remove the flaps 37 from the box. The user would also open the box spout aperture 46 by breaking the perforations 49 along flap 48 and pulling bladder spout 68 out of the box through box spout aperture 46. Either before or after the above steps, if not already done prior to that time, the user would break the perforations around the handle flaps 42 and fold handle flaps 42, FIG. 2, into the box to create openings 44 and box handles 40. This provides the bag-in-box container 10 as shown in FIG. 1. The user picks up the box 10 using handles 40 and lifts it over receiving receptacle 220 as shown in FIG. 7, and lowers the bag-in-box container 10 into receptacle 220 to the position shown in FIG. 8. While lowering the bag-in-box container 10 into receptacle 220, the user is careful to align the spout 68 so its intermediate narrow portion 70 is received in the top of slot 222 and slides along slot 222 as the container is lowered into the receptacle. The slot 222 will hold the spout in extended position at the lower end of slot 222 as shown in FIGS. 8 and 9. In this position, the spout is ready to be operated to dispense liquid from the container. However, prior to starting to dispense liquid from the container, the temperature regulation unit is activated to begin adjustment of and regulation of the temperature of the liquid in the container.

Figure 10:
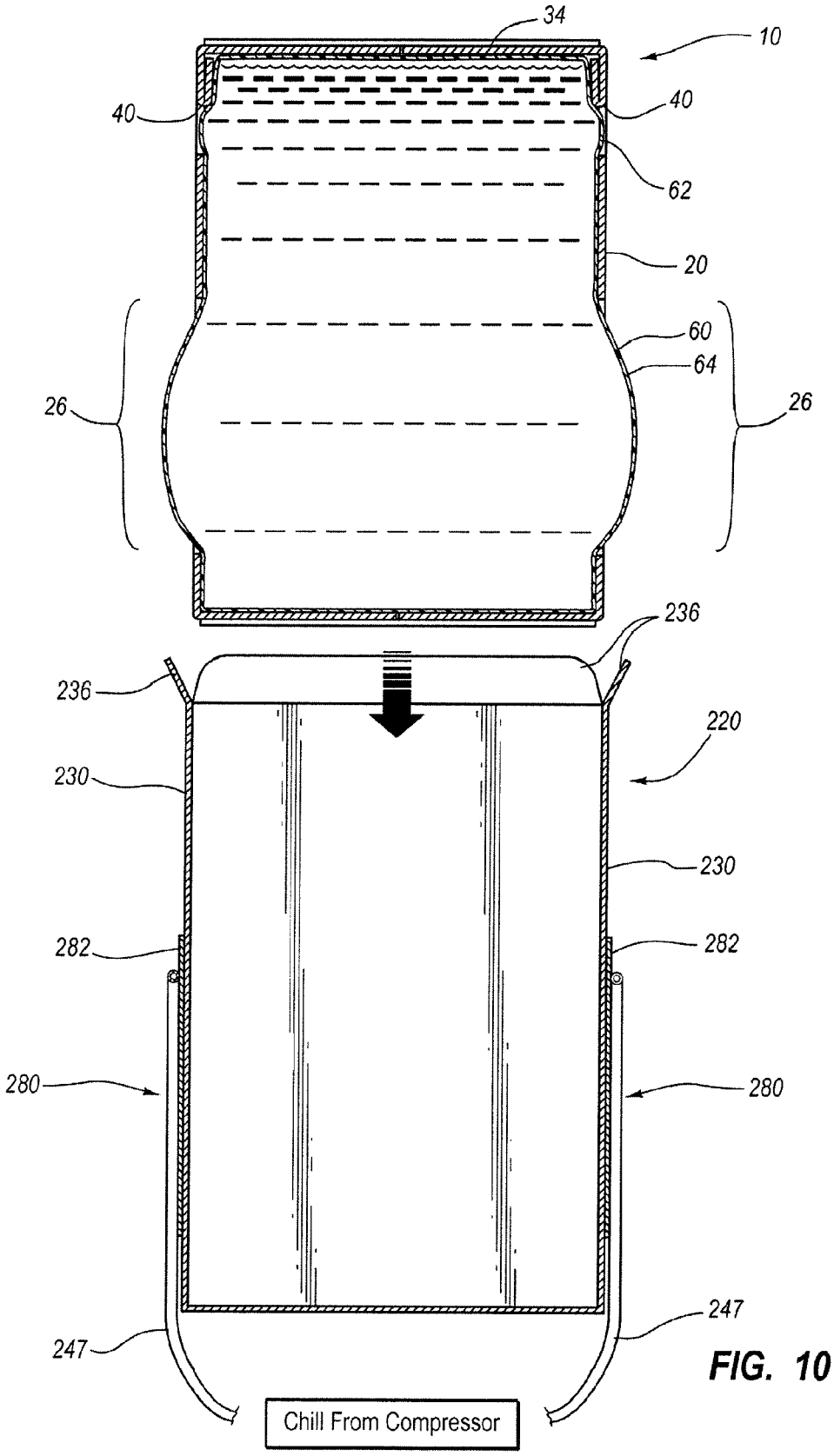
FIG. 10 is an enlarged fragmentary cross sectional front view of the dispenser of FIG. 7, shown with the bag-in-box liquid storage container of FIG. 1 ready to be placed in the receiving receptacle.
Figure 11:
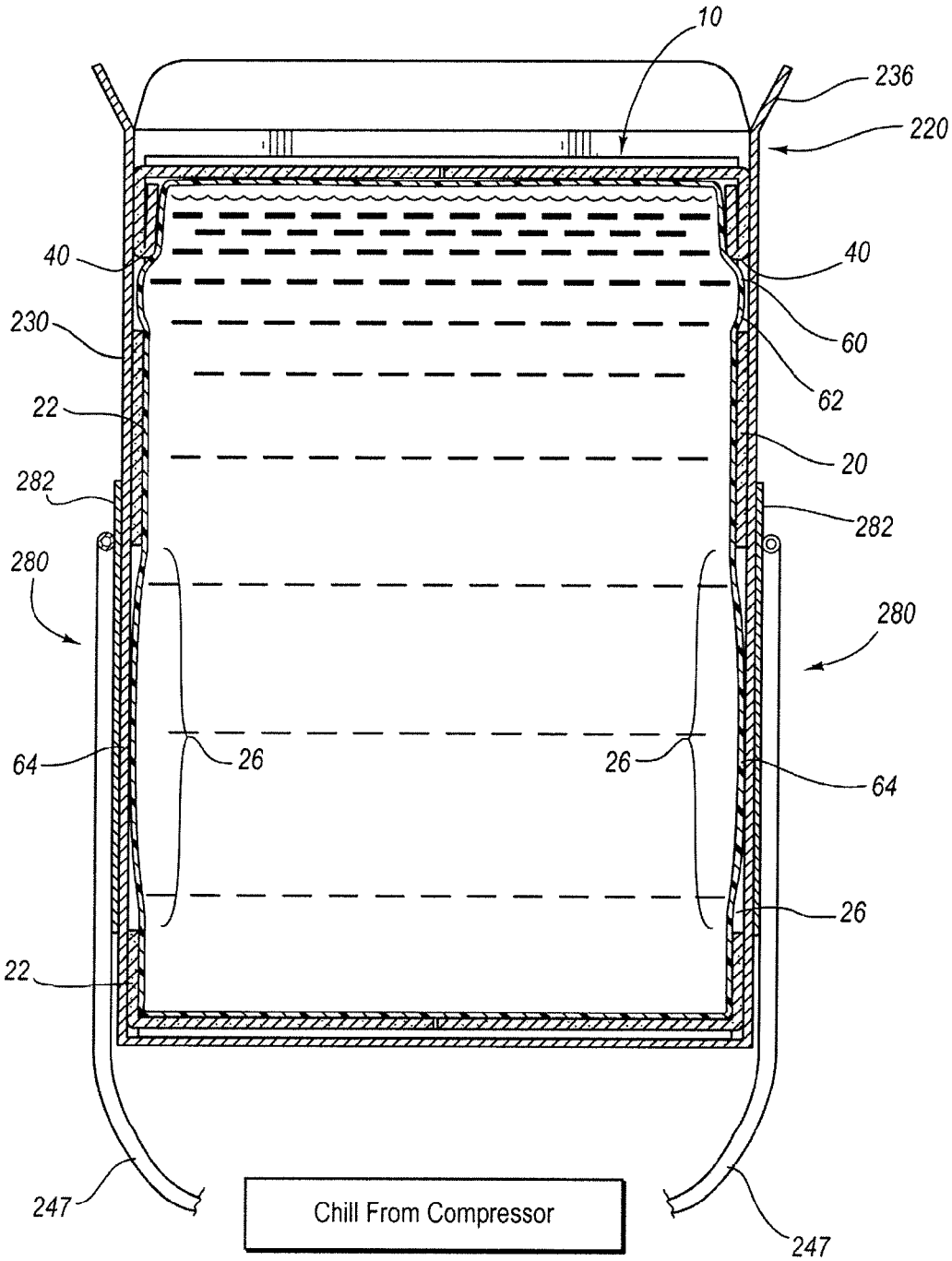
FIG. 11 is a fragmentary cross sectional front view of the dispenser of FIG. 8, shown with the bag-in-box liquid storage container placed in the receiving receptacle.

FIG. 10 shows the bag-in-box container 10, as also shown in FIG. 7, positioned above receptacle 220 ready to be lowered into receptacle 220. Receptacle 220 includes sloped top flanges 236 to help guide the container into the receptacle and help guide bladder bulges 64 into the receptacle. FIG. 11 is similar to FIG. 10 but shows box 10, as does FIG. 8, lowered into receptacle 220. As shown in FIG. 11, when box 10 is in received position in receptacle 220, the bulges 64 of bladder 60 are substantially against the receptacle inside walls adjacent the thermal conduction pad plates 282 so that thermal energy is transferred by conduction between the thermal conduction pad plate 282, through the receptacle wall 230 and the bladder membrane 62, and the liquid in the bladder. Thermal energy is not transferred through the box shell material 22, since there is no box shell material in thermal conduction windows 26. For cooling the contents of the container 10, heat is transferred from the liquid in the container to the thermal conduction pads and to heat the liquid, heat is transferred from the thermal conduction pads to the liquid in the container. In addition, the thermal conduction pads generally have a higher heat capacity than does air so can absorb or give off much more heat per unit time than does air. This provides much faster cooling or heating of the liquid in the container than does merely cool air surrounding the container in a refrigerator or hot air surrounding the container in a hot air environment, even with circulation of the cool or hot air around the container. Thus, an important feature of the dispenser of the invention is that thermal conduction pads are used in thermal conductive relationship with the liquid storage containers to provide improved and more rapid cooling and heating of the containers and liquid contained therein than would be obtained by heat transfer from the atmosphere (cooled or heated air) surrounding the container.

Figure 12:
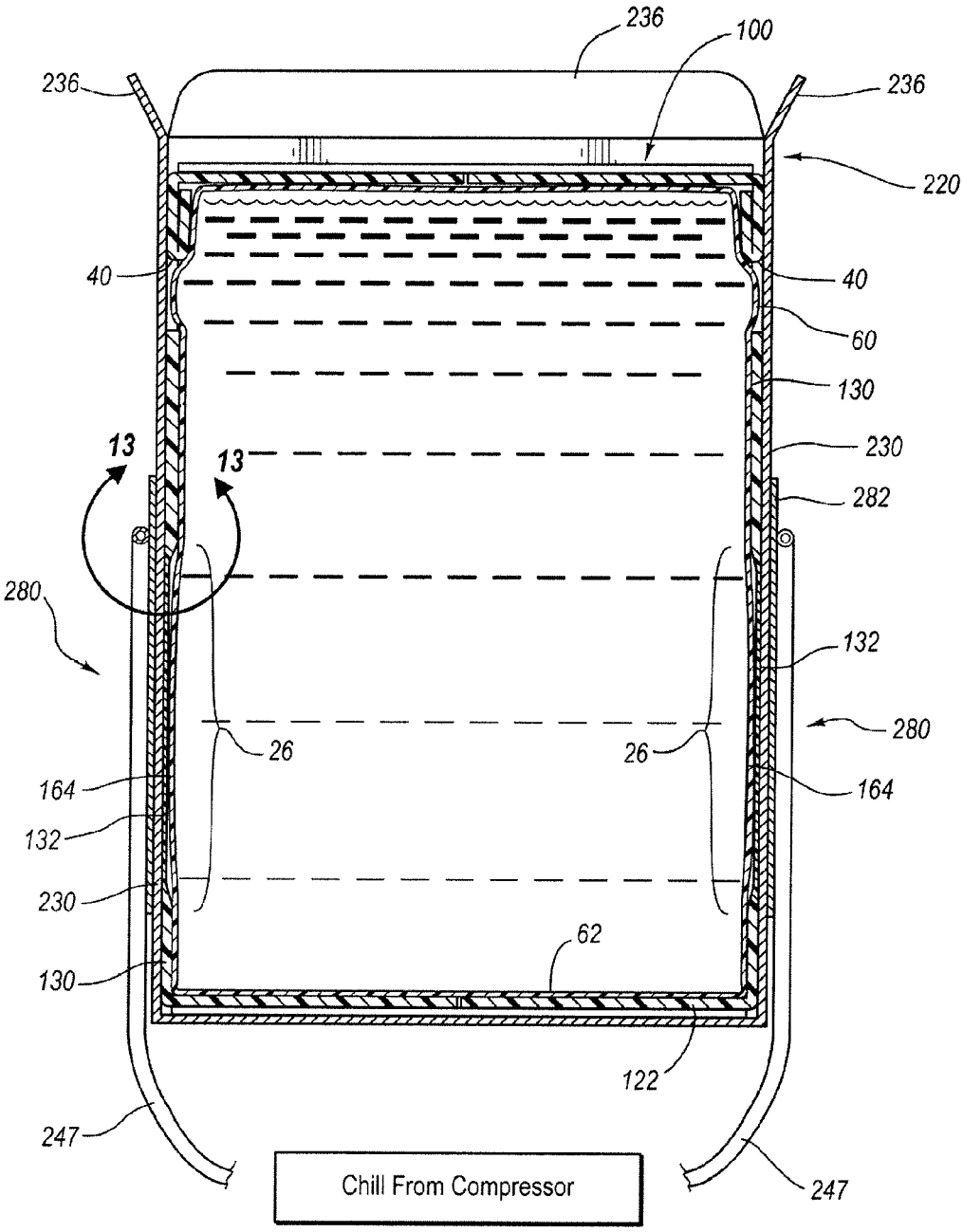
FIG. 12 is a fragmentary cross sectional front view of the dispenser of FIG. 8, similar to that of FIG. 11, shown with the bag-in-box storage container of FIG. 4 placed in the receiving receptacle.

FIG. 12 shows a bag-in-box container 100 lowered into received position in receiving receptacle 220. As shown in FIG. 12, when box 100 is in received position in receptacle 220, the thermal conduction windows 126 of box 100 are substantially against the receptacle inside walls adjacent the thermal conduction pad plates 282 so that thermal energy is transferred by conduction between the thermal conduction pad plate 282, through the receptacle wall 230, the thermal conduction window 126 of box 100, which has better heat conduction properties than does the rest of box 100, and the bladder membrane 62, and the liquid in the bladder. Heat is not transferred through the usual box shell material 122.

Figure 13:
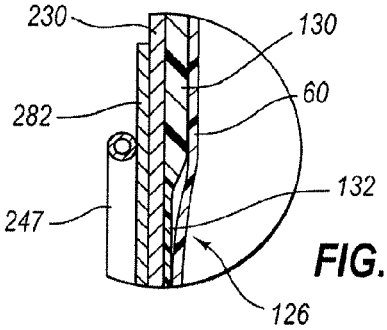
FIG. 13 is an enlarged fragmentary cross sectional front view of the portion of the dispenser of FIG. 12 enclosed by arrow 13-13 in FIG. 12.

FIG. 13 is an enlarged portion of FIG. 12 showing the bag-in-box container 100 in received position in receptacle 220 with thermal conduction window 126 positioned against the portion of receptacle wall 230 in conductive contact with thermal conductive pad plate 282, which is in thermal conductive contact with tubing 247 extending from temperature regulation unit 240.

Figure 14:
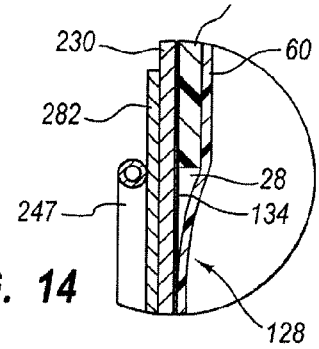
FIG. 14 is a view similar to that of FIG. 13, but showing the bag-in-box container of FIG. 6 in the dispenser of FIG. 12.

FIG. 14 shows a similar enlarged view to that of FIG. 13, but showing the bag-in-box container 10 having a covering material 134 as shown in FIG. 6 covering the open thermal conduction window to form the covered open thermal conduction window 128 as shown in FIG. 6.

Figure 15:
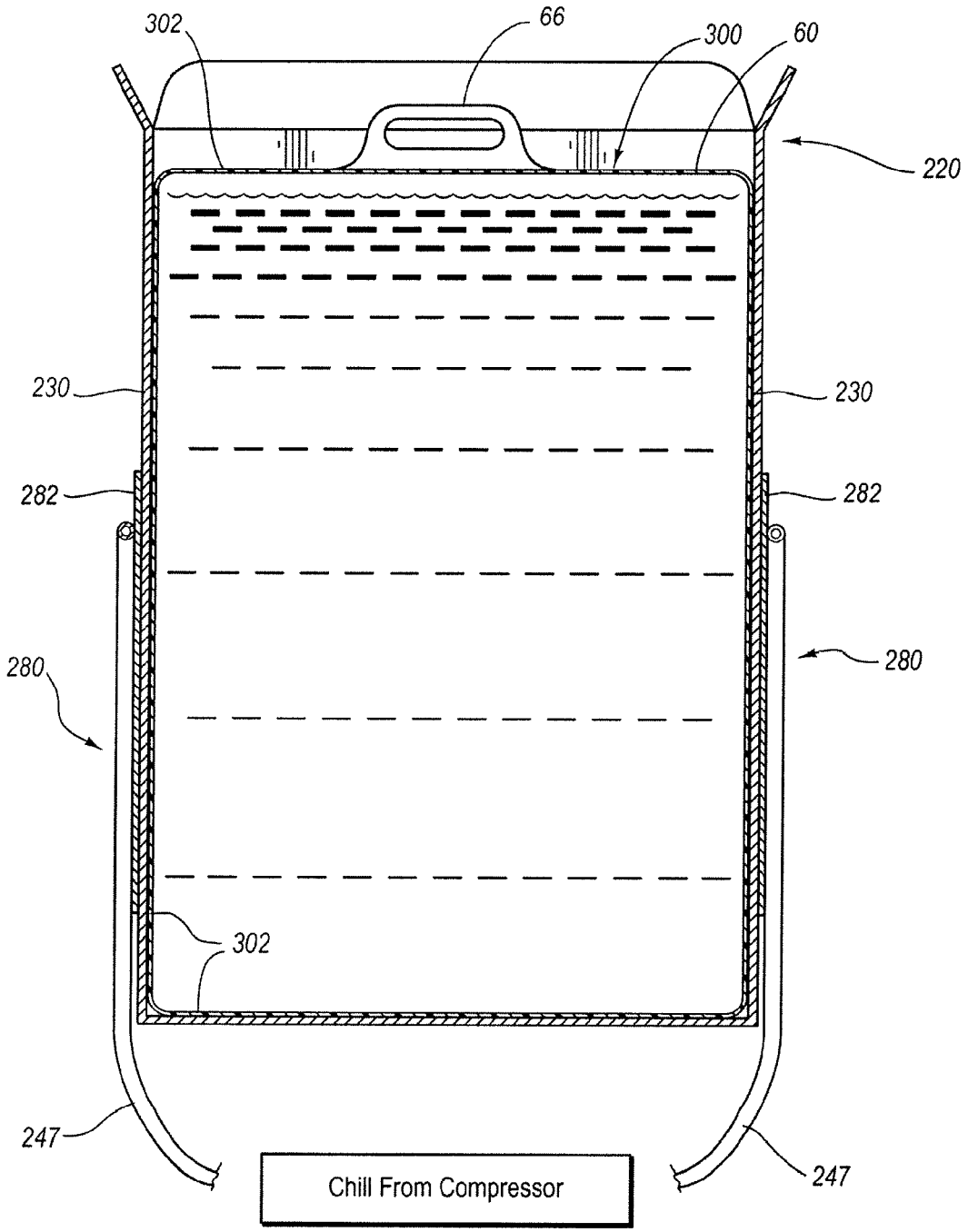
FIG. 15 is a fragmentary cross sectional front view of the storage container of FIG. 8, similar to that of FIG. 11, shown with a flexible bladder inner container from the bag-in-box storage container of FIG. 1 removed from the box and placed directly in the receiving receptacle.
Figure 19:
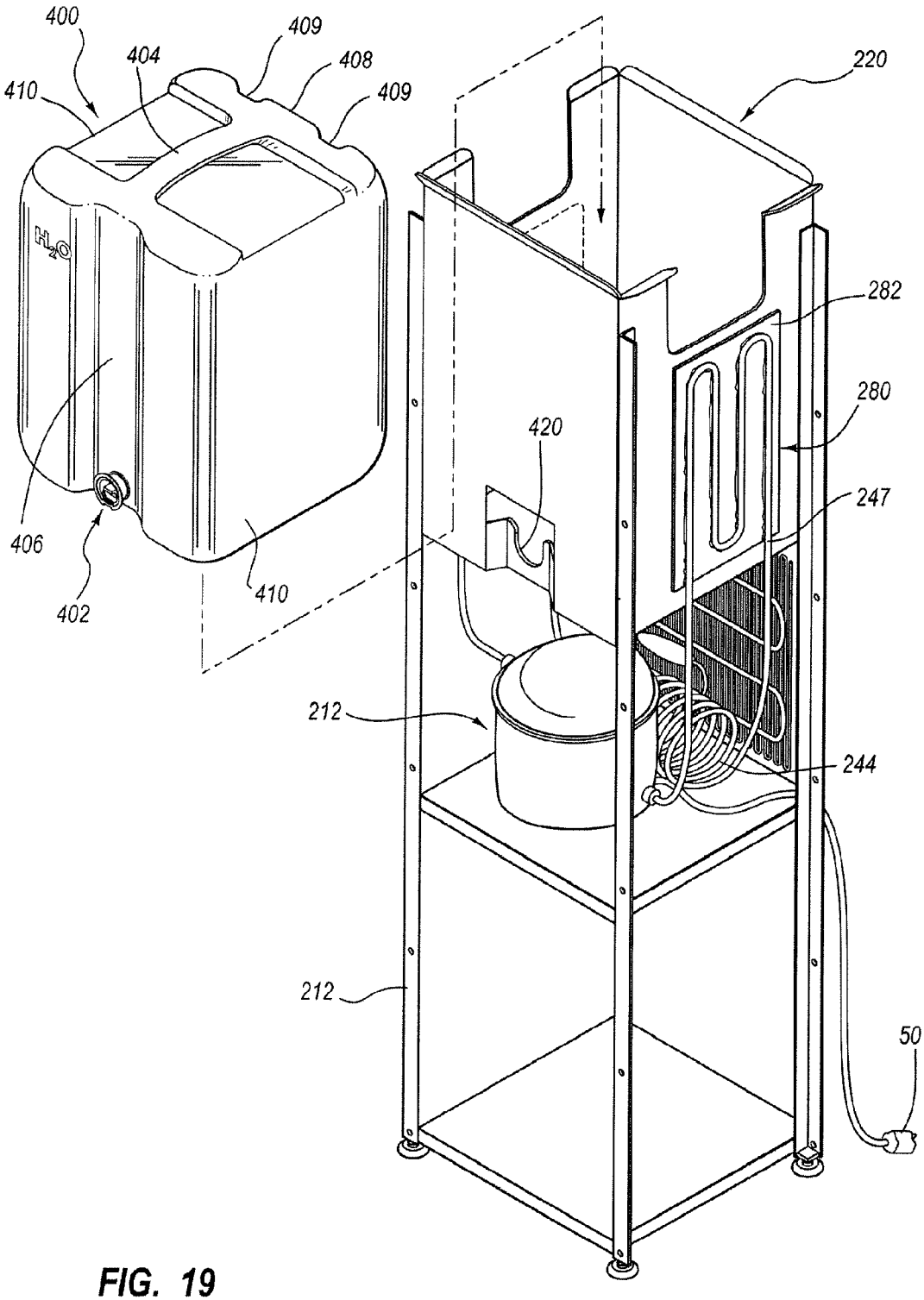
FIG. 19 is a perspective view of the dispenser of FIG. 7 shown with a rigid liquid storage container of the invention ready to be placed in the receiving receptacle of the dispenser.
Figure 20:
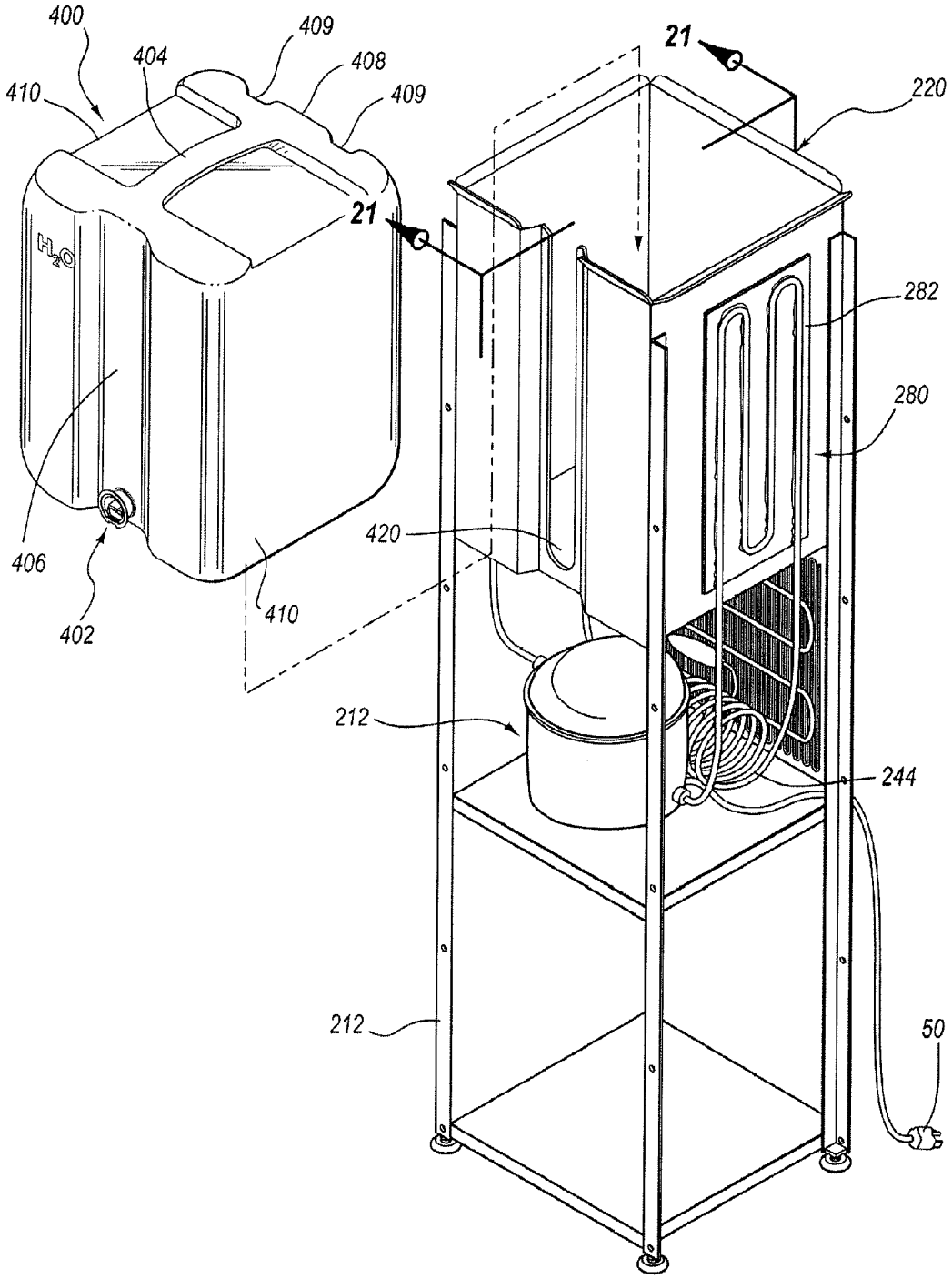
FIG. 20 is a perspective view of the dispenser of FIG. 19, shown with the liquid storage container of FIG. 19 placed in the receiving receptacle of the dispenser.
Figure 21:
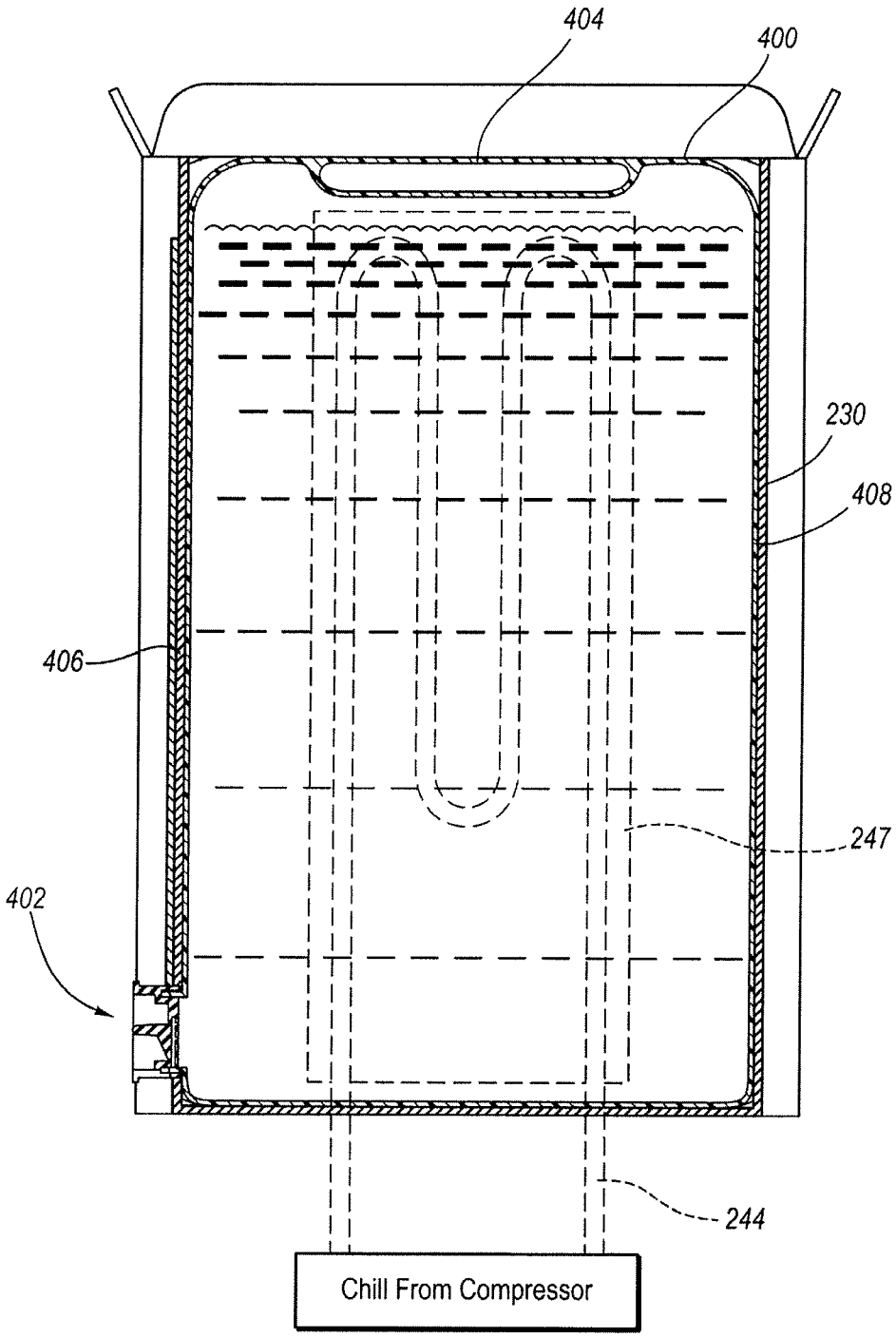
FIG. 21 is a fragmentary cross sectional side view taken on the line 21-21 of FIG. 20.

FIG. 15 shows a single wall liquid storage container, rather than a bag-in-box container that includes a container (bladder) within a container (box), lowered into receptacle 220. The single wall liquid container can be a flexible container such as the bladder 60 removed from a box of a bag-in-box container such as 10 or 100 as described above, a semi-flexible container, or a substantially rigid container such as a plastic container 400 as shown in FIGS. 19-21, as will be described below. As shown in FIG. 15, single wall container 300 is in received position in receptacle 220, with container walls 302 substantially against the receptacle inside walls adjacent the thermal conduction pad plates 282 so that thermal energy is transferred by conduction between the thermal conduction pad plates 282, through the receptacle wall 230 and the container wall 302, and the liquid in the container.

Where the single wall container is a flexible bladder, such as bladder 60, from a bag-in-box container, such as bag-in-box container 10, the bladder 60 is removed from the bag-in-box container 10 by opening the top 33 of the box and removing the bladder 60, by use of bladder handle 66, from the box. The bladder is then positioned over receptacle 220 and lowered into receptacle 220 into the position shown in FIG. 15. The flexible bladder, under the influence of the fluid therein, will conform to the shape of the receptacle 220 and will directly contact the inside wall of the receptacle 220 and will directly contact in thermal conductive relationship the portions of the inside wall of the receptacle 220 adjacent to and in thermal conductive relationship with the thermal conduction pad plates 282. Thermal energy is then transferred by conduction between the thermal conduction pad plates 282, through the receptacle wall 230 and the container wall 302, and the liquid in the container.

Figure 16:
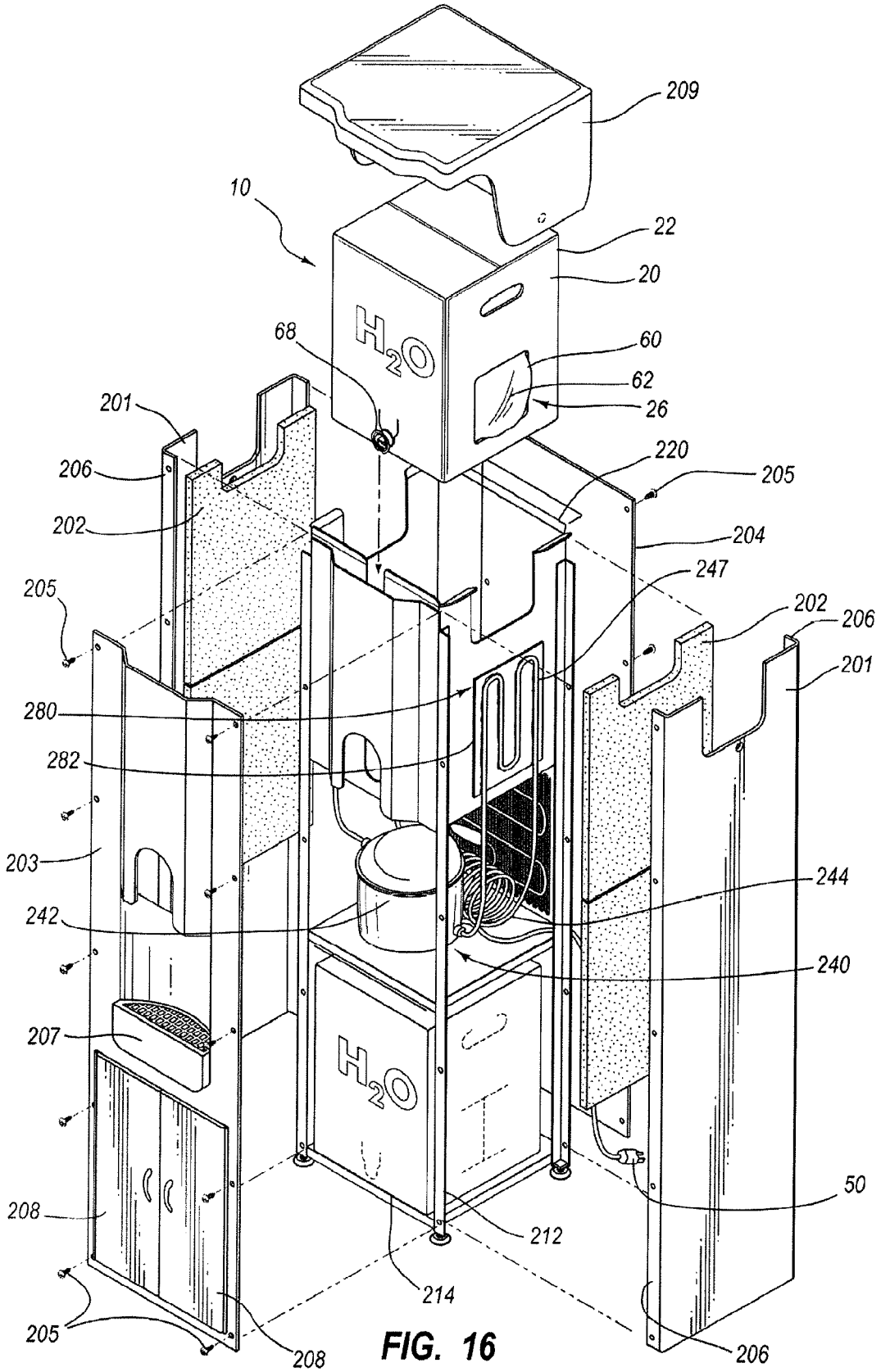
FIG. 16 is an exploded perspective view of a dispenser in accordance with an embodiment of the present invention, showing a cover on the dispenser of FIG. 7.
Figure 17:
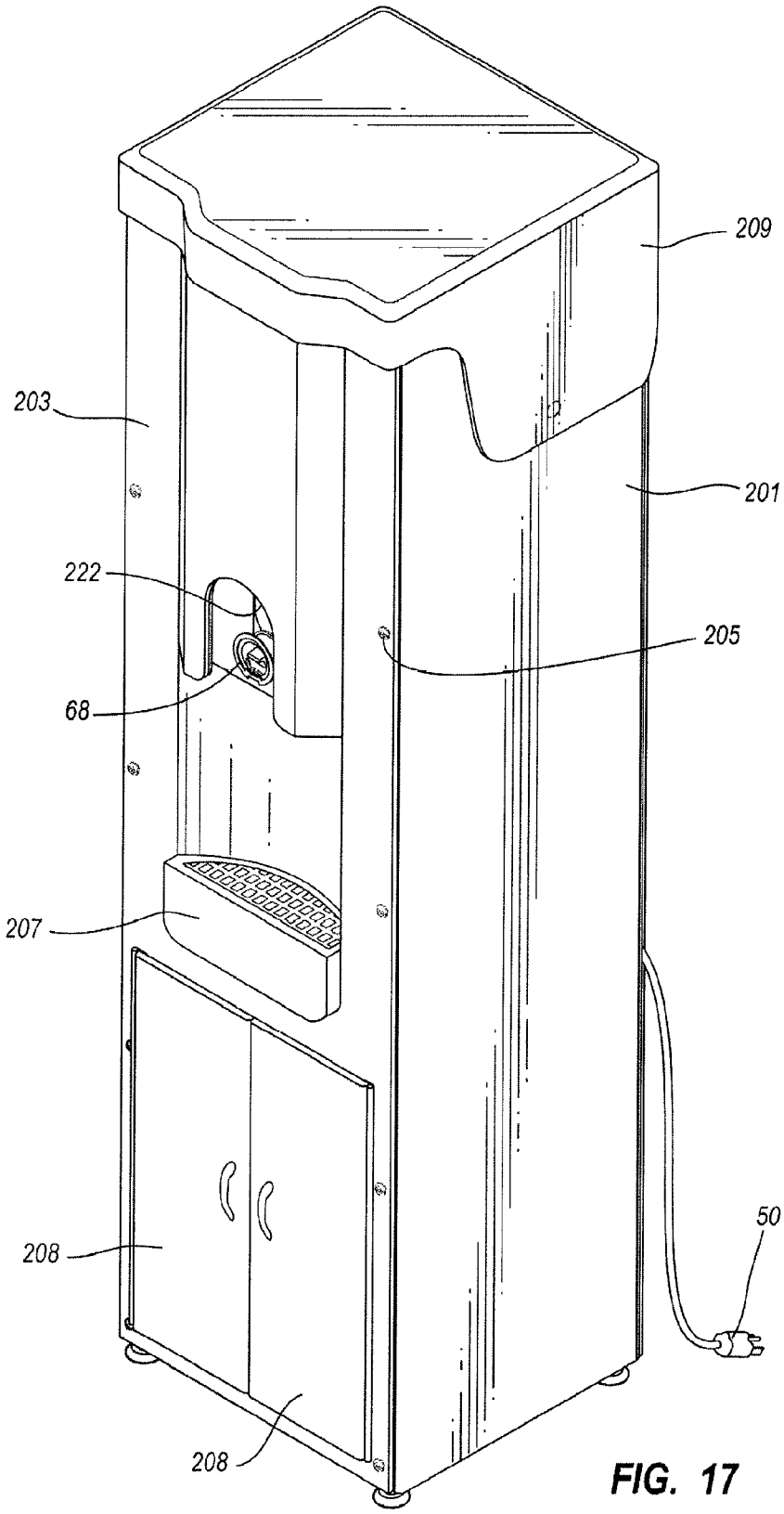
FIG. 17 is a perspective view of the assembled dispenser of FIG. 16.
Figure 18:
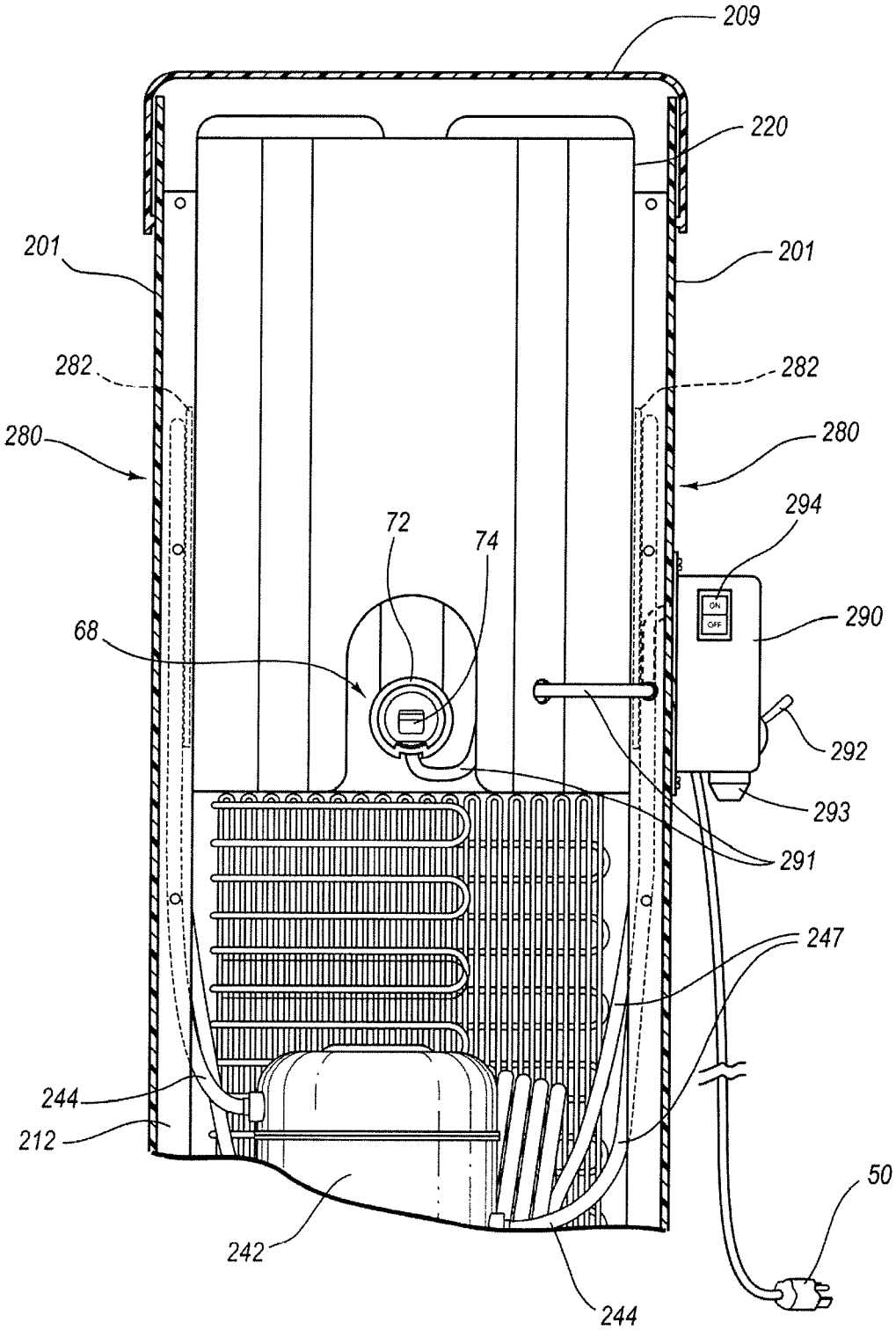
FIG. 18 is an enlarged fragmentary cross sectional front view of the dispensing station of FIG. 17, additionally showing a liquid heating unit mounted on the dispenser.

The dispenser 200 as shown in FIGS. 7-9 shows, for illustration purposes, the basic functional components of a dispenser of the invention, i.e., the receptacle 220 for receiving a liquid containing container, the thermal conduction pads 280, the temperature regulation unit 240, and the supporting stand 212. FIGS. 16-18 show additional elements of the dispenser that would usually be included in a complete commercial dispenser. Thus, the dispenser of FIGS. 16-18 include side panels 201 disposed over the sides of stand 212, with insulation sheets 202 to help maintain the temperature of the thermal regulation unit 240, the tubing 247 extending between the thermal regulation unit and the thermal conduction pads, the thermal conduction pads 280, and the receptacle 220. Front panel 203 and rear panel 204 are secured to supporting stand 212 by screws 205 which also pass through flanges 206 on side panels 201 to secure all panels to the supporting stand. The front panel 203 has a drip basin 207 that can catch excess liquid that might drip from the spout 68 after dispensing liquid from the container received in receptacle 220. The front panel 203 also includes doors 208 that provide access to the storage shelf 214 of the stand 212. A dispenser top 209 is pivotally mounted to the side panels 201 to pivot between an open position to allow a fluid containing container to be placed in or removed from the receptacle and a closed position covering the top of the receptacle.

The dispenser of FIGS. 7-9, 16, and 17 is shown as and is principally directed to dispensing a cooled liquid from the dispenser so that the temperature regulation unit shown is a refrigeration unit which supplies coolant to the thermal conduction pads to cool the thermal conduction pads to thereby draw heat from the liquid in the liquid storage container and cool the liquid. All of the liquid in the liquid storage container is cooled to and maintained at a desired cooled temperature by the dispenser. Thus, the entire contents of the liquid storage container is available for dispensing from the dispenser as quickly as the liquid can be emptied from the container through spout 68. If it is desired to provide an entire container of heated liquid, the temperature regulation unit would be a heating unit as described as an alternative to the refrigeration unit. As a further alternative, a temperature regulation unit that can be set to supply either heat or cold, as desired at a particular time, can be provided. In some instances, it is desired to be able to provide both hot and cold liquid at the same time. In such instance, it will need to be decided whether cooled liquid or heated liquid is the primary requirement and the dispenser will be chosen and/or set to either heat or cool the liquid in the container. In addition, an auxiliary heating or cooling unit can be provided to provide either heated or cooled liquid opposite from that in the container. For example, if the dispenser cools the liquid in the container, an auxiliary heating unit can be provided in the dispenser to also provide heated liquid if desired, while if the dispenser heats the liquid in the container, an auxiliary cooling unit can be provided in the dispenser to also provide cooled liquid.

The dispenser shown in FIG. 18 is the dispenser of FIGS. 16 and 17, which is configured to cool the liquid in the liquid storage container, with an example of an auxiliary heating unit 290 which can be provided to supply heated liquid, if desired, along with the cooled liquid provided directly from the container through spout 68. Tubing 291 connects to spout 68 between the container and the valve 74 so that liquid from the container is available to tubing 291 from spout 68 without being controlled by valve 74. Tubing 291 extends from spout 68 to heating unit 290 to supply liquid from the container received in receptacle 220 to heating unit 290. A valve 292 in heating unit 290 controls the flow of liquid from the heating unit with the liquid from the heating unit flowing from spout 293 when valve 292 is opened to allow flow of liquid. The heating unit 290 is shown mounted on a side of the dispenser, but could be mounted in various positions on the dispenser. It should be positioned near or below the bottom of the liquid containing container when received in the receptacle 220 so that the liquid will flow from the container to the heating unit by gravity, but could be positioned higher on the dispenser with water pumped from the container to the heating unit. An on-off switch 294 can be provided to activate the heating unit when desired. Power can be supplied to the heating unit from the same power source that powers the temperature regulation unit, here shown as a plug 50 to be plugged into a common electrical outlet supplying electrical power. Heating unit 290 can be of any type that can heat a liquid and then controllably dispense the heated liquid. For example, heating unit 290 can include an instant liquid heating unit as commercially available for installation in sinks to provide instant hot water. Alternatively, heating unit 290 can include a reservoir with a heating means in association with the reservoir to heat the liquid in the reservoir. Such a unit can be the same as currently used to supply hot water from a standard five gallon bottled water dispenser.

FIGS. 19-21 show a basic dispenser similar to that shown in FIGS. 7-9, but with receptacle configured to receive a substantially rigid container 400. The container 400 is formed of a substantially rigid plastic material, although other heat conductive material could be used. The container 400 includes a spout 402 at the bottom thereof and a handle 404 at the top. The container 400 is configured with a front recess 406 in which the spout 402 is mounted, a back 408 with a pair of recesses 409, and opposite sides 410 with substantially smooth sides. The dispenser is similar to that of prior Figs. and includes the receptacle 220 for receiving the liquid storage container 400 therein, at least one thermal conduction pad 280, and a temperature regulation unit 240. The container is placed in the receptacle similarly to placing the container in the receptacle of the dispenser of FIGS. 7-9 and operation of the dispenser is the same. When the container 400 is placed in the receiving receptacle 220, the substantially smooth sides 410 are positioned in thermal conductive relationship with the portion of the receptacle walls adjacent to the thermal conductive pad plates 282, and form the thermal transfer portions for the container 400. Spout 402 rests in dispenser spout receiving cradle 420. Where the rigid liquid storage container 400 is sized and shaped to be the same size and shape as bag-in-box containers 10 or 100, any of the liquid storage containers 400, 10, or 100 can be used in the same dispenser.

A rigid liquid storage container, such as liquid storage container 400, can have various configurations. The important requirements are that the container include thermal transfer portions that will be positioned in thermally conductive relationship with the thermal conduction pads of the receiving receptacle of the dispenser when the container is received in the receptacle, and that the spout or other dispensing mechanism for dispensing liquid from the liquid storage container is positioned so as to be accessible to a user to dispense liquid from the container when the container is received in the receptacle. These requirements will also apply to any other liquid storage container to be used with the dispenser, such as a semi-rigid or flexible container.

Figure 22:
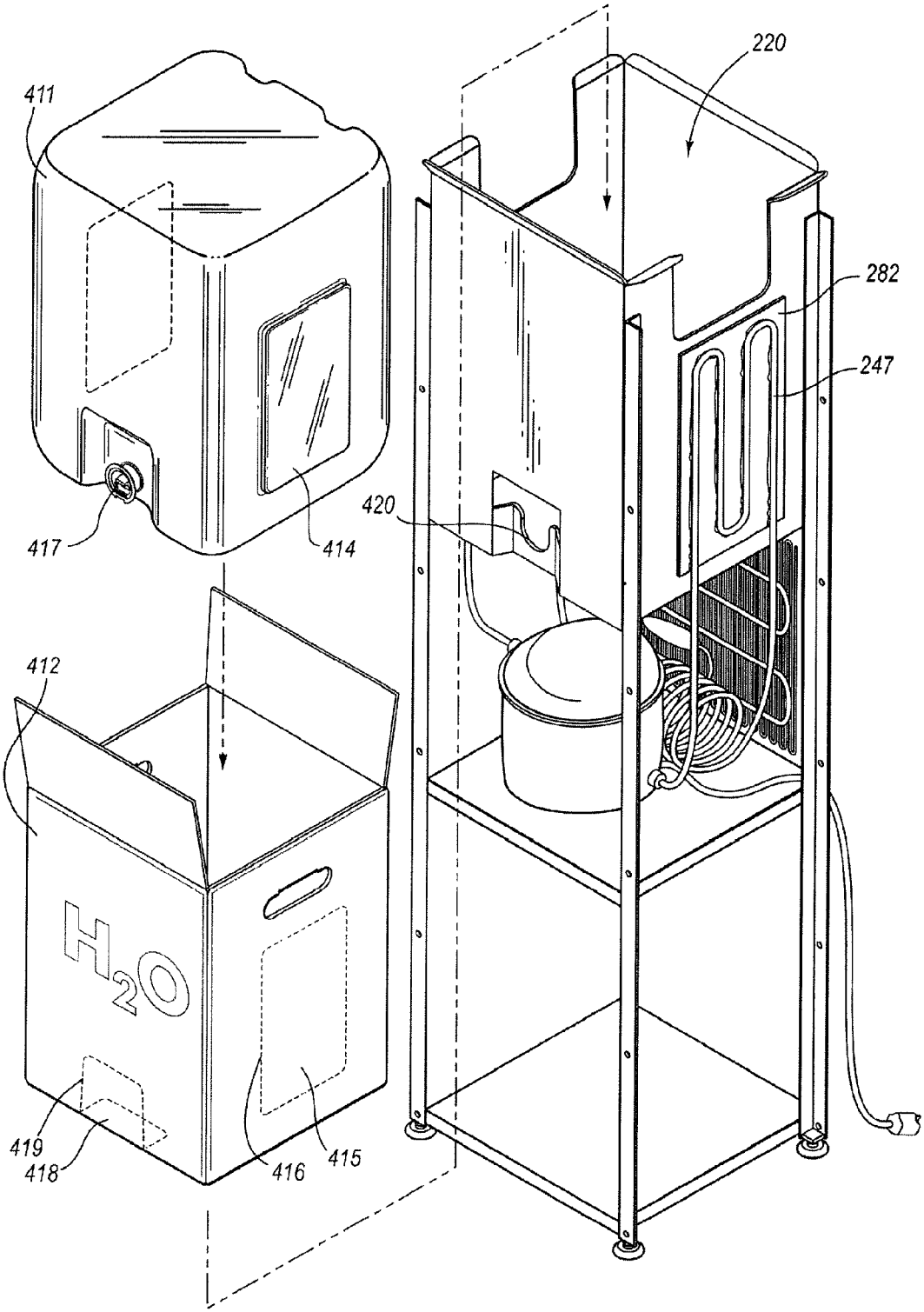
FIG. 22 is a perspective view of the dispenser of FIG. 7 shown with a different embodiment of bag-in-box liquid storage container of the invention.
Figure 23:
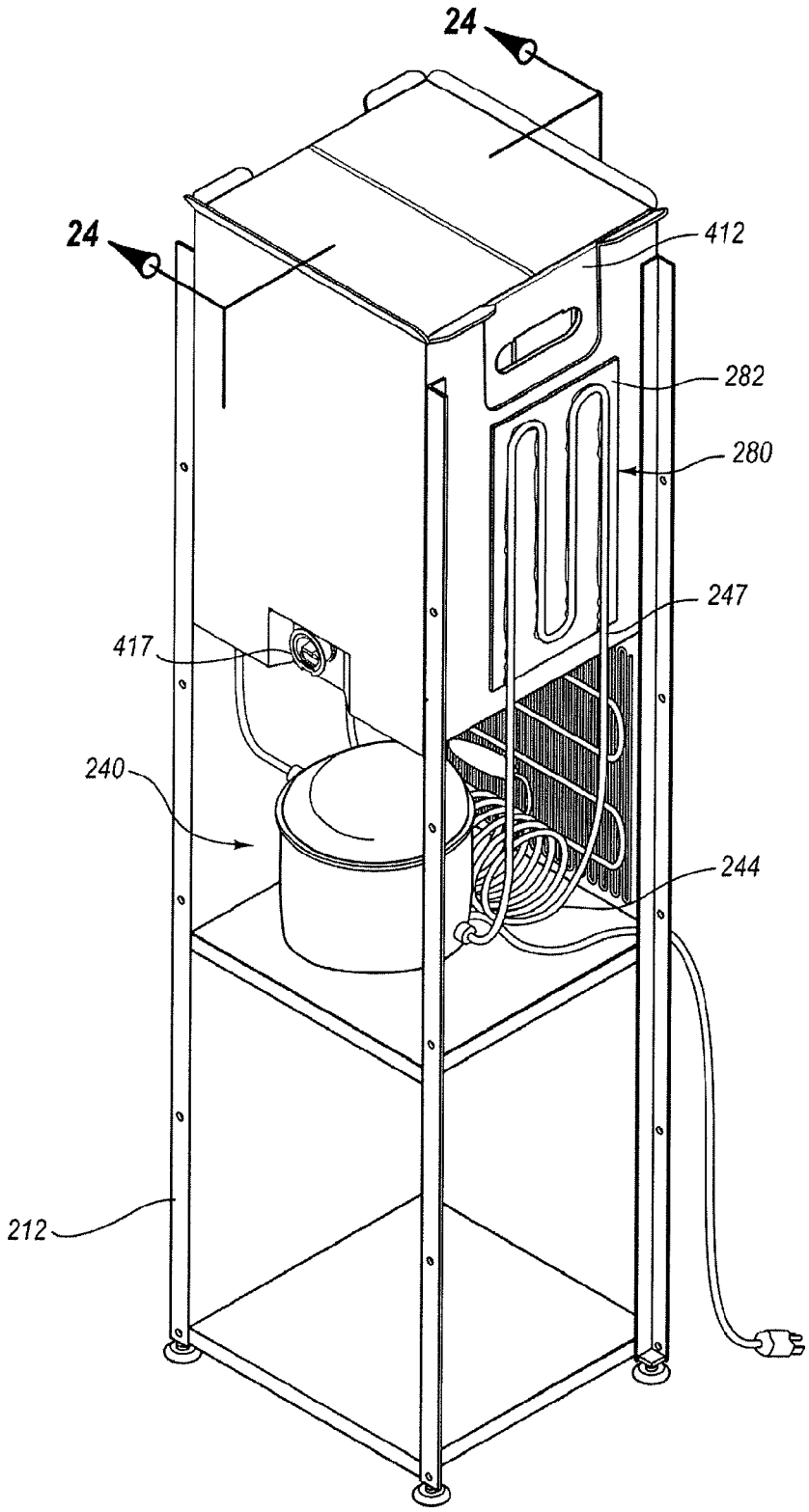
FIG. 23 is a perspective view of the dispenser of FIG. 22, shown with the bag-in-box liquid storage container of FIG. 22 placed in the receiving receptacle of the dispenser.
Figure 24:
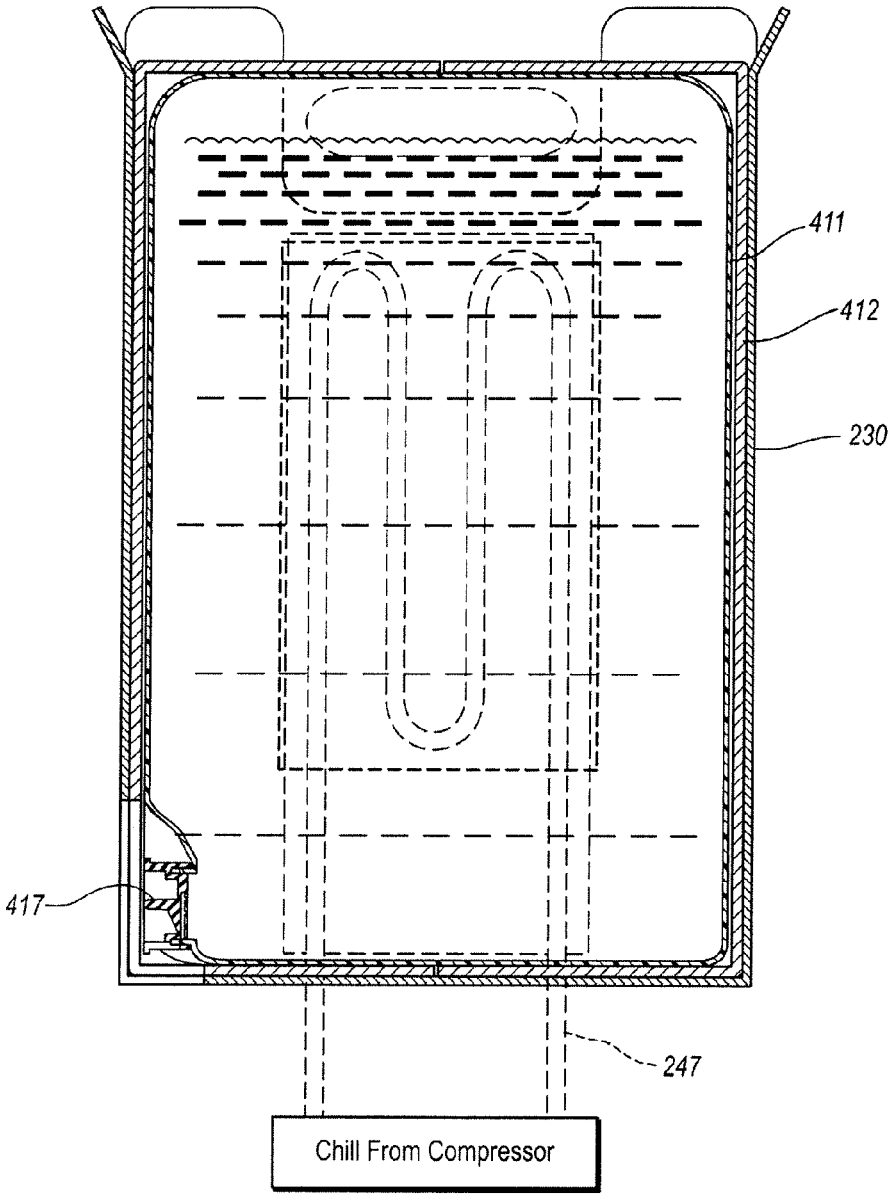
FIG. 24 is a fragmentary cross sectional side view taken on the line 24-24 of FIG. 23.

FIGS. 22-24 show the same basic dispenser as shown in FIGS. 19-21 with a receptacle 220 for receiving a liquid storage container therein, at least one thermal conduction pad 280, and a temperature regulation unit 240. The difference is that the receptacle 220 is shown receiving a bag-in-box container with a semi-rigid inner container 411 positioned in box 412, similarly to, but rather than, the flexible bladder container 60 previously described. The inner container 411 is flexible enough so that thermal transfer portions 414 will flex into the container 411 when container 411 is placed in box 412. Box 412 includes removable panels 415 defined by perforations 416 which are removed prior to positioning box 412 into receptacle 220. With panels 415 removed, thermal transfer portions 414 will move outwardly to fill the space previously occupied by panels 415 so that the thermal conduction portions 414 will fill the thermal conduction windows formed in box 412 by removal of panels 415. This positions the outside surface of the thermal transfer portions 414 of container 411 along the outside surface of box 412 to be in thermal conductive relationship with the portion of the receptacle walls adjacent to the thermal conductive pad plates 282. The container 411 includes a spout 417 at the bottom thereof which is exposed for use by removal of panel 418 defined by perforations 419 in box 412. Spout 417, after removal of panel 418, rests in dispenser spout receiving cradle 420.

Rather than inner container 411 being semi-rigid, inner container 411 can be substantially rigid as box 412, usually considered as substantially rigid when made of cardboard or plastic, will usually still have enough flexibility to allow thermal transfer portions 414 of a substantially rigid container 411 to flex box 412 to the extent necessary to allow container 411 to be inserted into box 412 with thermal transfer portions 414 moving into and being received in the thermal conduction windows of box 412 so that the outside surface of the thermal transfer portions 414 of container 411 will be positioned along the outside surface of box 412 to be in thermal conductive relationship with the portion of the receptacle walls adjacent to the thermal conductive pad plates 282 when the box with the inner container 411 placed therein is received in the dispenser receptacle 220. It should be noted that for purposes of the invention, a bag-in-box liquid storage container is considered as a bag-in-box container regardless of whether the inner container in the box is flexible, semi-rigid, or rigid, although each of the flexible, semi-rigid, or rigid inner containers in the box have different properties and depending upon the circumstances, may have different advantages and disadvantages. For example, while the bag-in-box container will provide shape to a non-shape retaining flexible or semi-rigid inner container, important for storage and handling of the container, the box will usually also provide strength and reinforcement to a substantially rigid inner container, also important for handling, storage, and transportation of such substantially rigid inner container. Further, the box is useful for keeping all types of inner containers clean, a factor sometimes important in food handling, even with a substantially rigid inner container.

Figure 33:
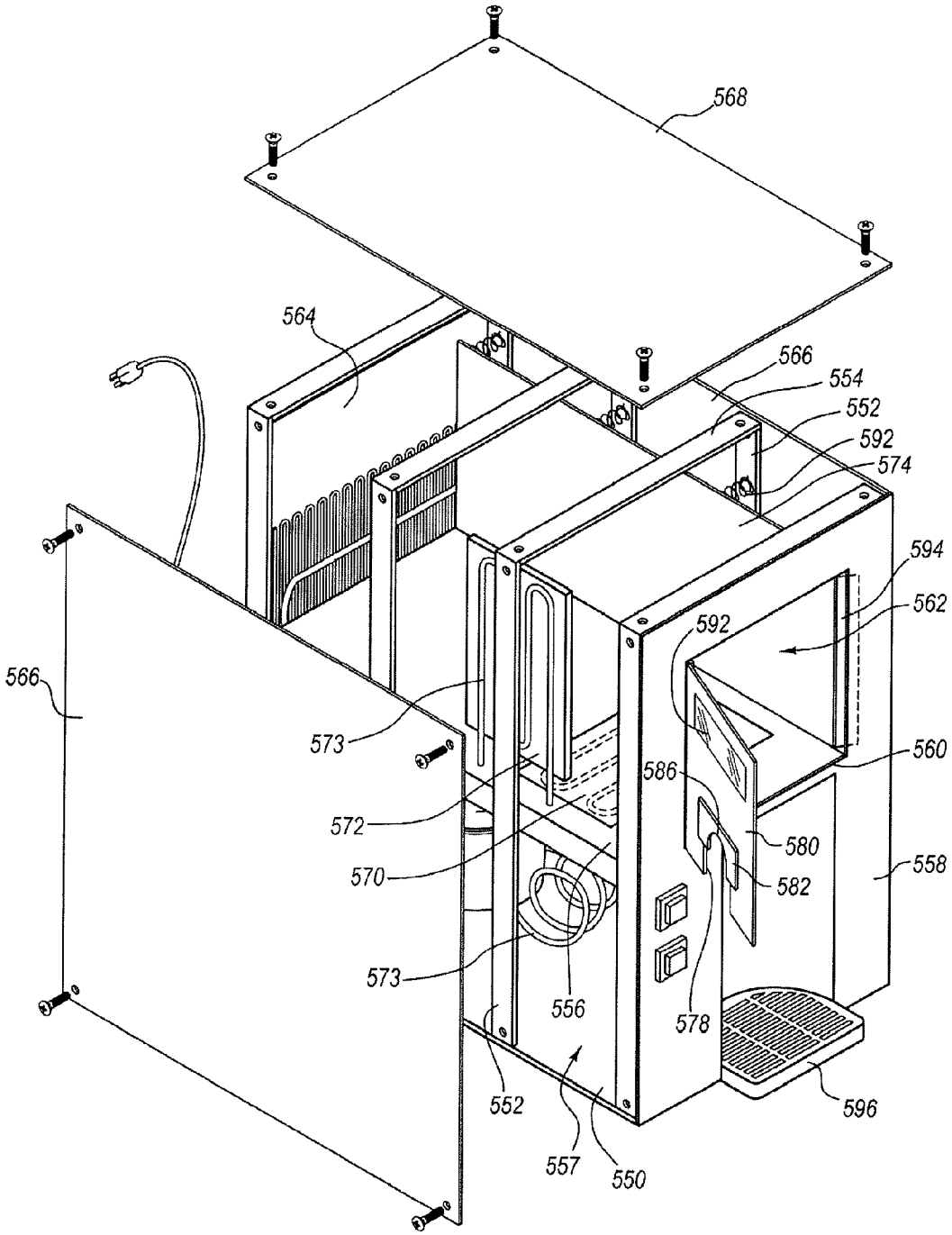
FIG. 33 is a somewhat schematic perspective view of a further embodiment of a dispenser of the invention.
Figure 34:
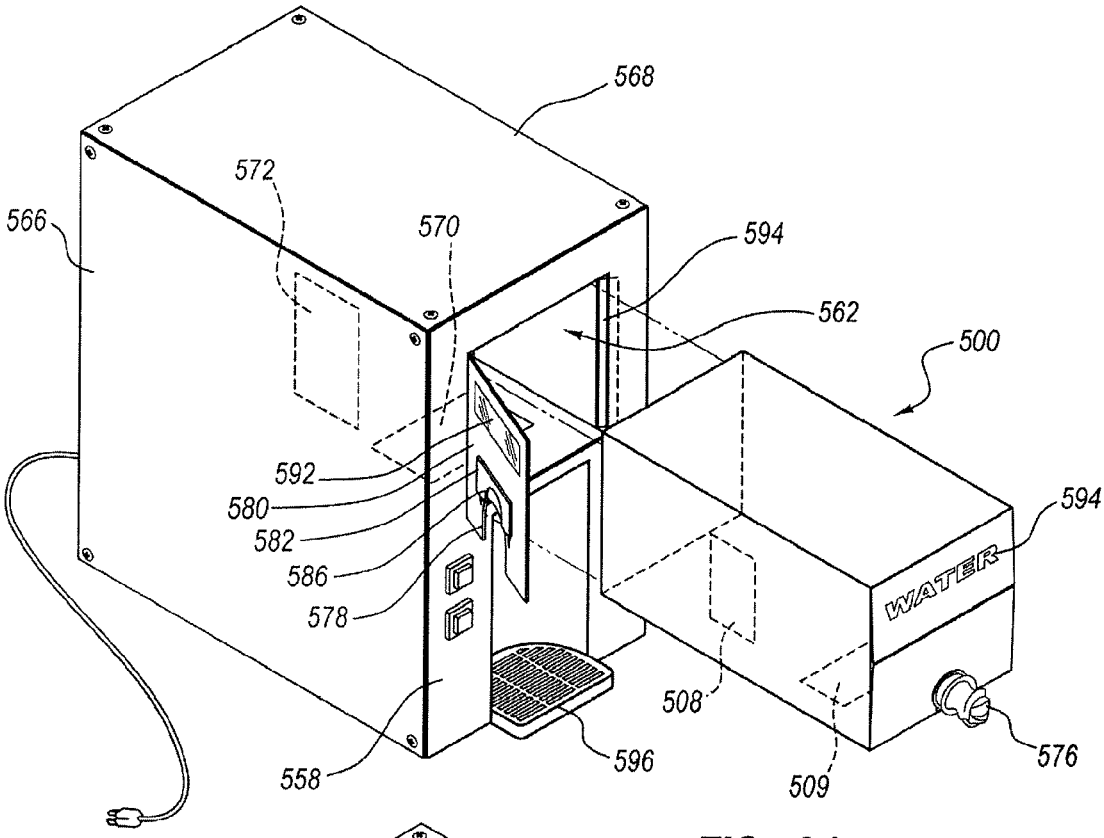
FIG. 34 is a perspective view of the dispenser of FIG. 33 with the liquid storage container of FIG. 28 ready to be inserted into the dispenser.
Figure 35:
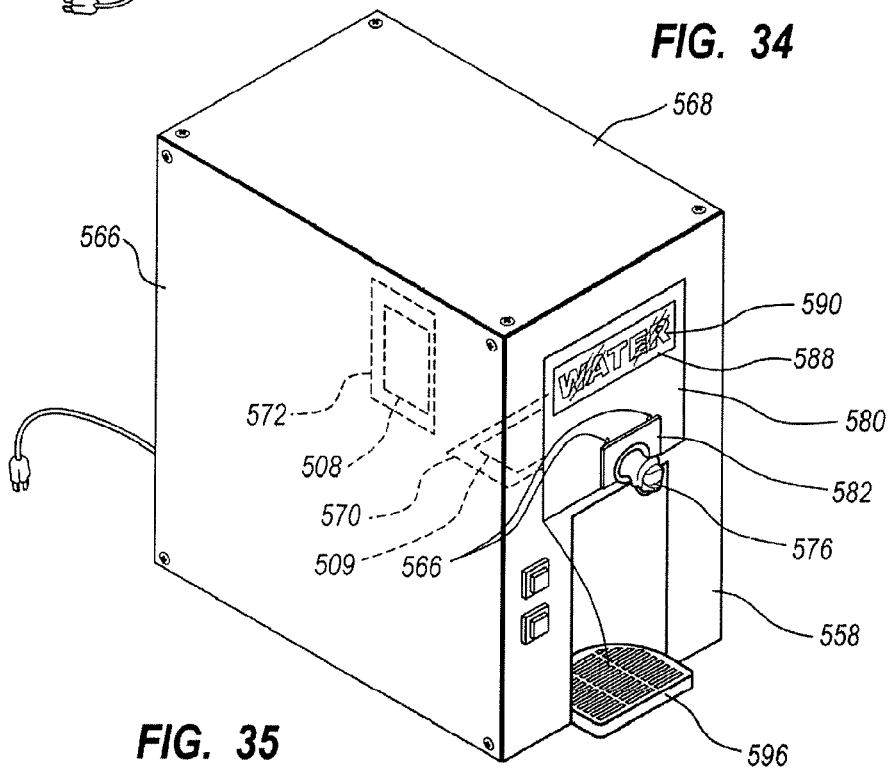
FIG. 35 is a perspective view of the dispenser of FIG. 33 with the liquid storage container of FIG. 28 inserted into the dispenser.

While the dispenser embodiments shown and described so far have included a stand supporting the receptacle with thermal conduction pads and temperature regulation unit above the floor, the dispenser can also be configured to be supported on a counter top, shelf, or other similar supporting surface. Further, while the dispenser embodiments shown and described so far have included a receptacle wherein the liquid storage container is inserted through the top of the receptacle, the dispenser can also be configured to receive the liquid storage container horizontally through a side of the receptacle. Further, the thermal conduction windows in the liquid storage container can be located in various positions, as can be the spout for dispensing the liquid from the container. FIGS. 33-35 show an embodiment of the invention configured to be supported on a counter top and having a front side opening in the receptacle to receive the liquid storage container. The liquid storage container shown in FIG. 28 is configured specifically for use with a dispenser having a front side opening to receive the liquid storage container therethrough.

Referring to FIG. 33, the dispenser includes a base 550 with side frame members 552 secpured thereto and extending upwardly to secure top frame members 554 between the tops of respective pairs of opposite side frame members. A liquid storage container support shelf 556 is secured between opposite side frame members 552 to form the floor of a liquid storage container receptacle, indicated generally as 562, located above the shelf 556, and a temperature control unit area 557, located below the shelf 556. The temperature control unit area 557 below shelf 556 provides space for a temperature control unit, as previously described, to provide cooling or heating to thermal conduction pads in the dispenser. A dispenser front plate 558 is secured to the front of base 550 and the front side and top members 552 and 554 to form the front of the dispenser. Dispenser front plate 558 includes an opening 560 which defines the opening to the liquid storage container receptacle 562. A back plate 564 is secured to the back end of base 550 and the back side and top members 552 and 554 to form the back of the dispenser. Opposite side plates 566 are secured to opposite side frame members 552 to form the dispenser sides and a top plate 568 is secured to the top frame members 554 to form the dispenser top. A thermal conduction pad plate 570 is positioned in or on shelf 556 and a thermal conduction pad plate 572 is positioned in a vertical orientation above shelf 556 and secured in stationary position to act as a stationary wall forming a side of the liquid storage container receptacle 562. This showing of the thermal conduction pad plate 562 is somewhat schematic as such plate would normally be supported on, in, or behind a receptacle side wall, which is not shown in FIG. 33, but would be similar to the receptacle walls described for prior embodiments. Cooling or heating fluid is circulated, as previously described, from the temperature control unit through tubing 573 to the thermal conduction pad plates 570 and 572 to cool or heat the thermal conduction pad plates. An opposite liquid storage container receptacle side wall 574 is positioned in vertical orientation parallel to, and spaced from, thermal conduction pad plate 572 to form the opposite side wall of liquid storage container receptacle 562. A liquid storage container, such as bag-in-box liquid storage container 500, FIGS. 28, 34, and 35, can be inserted horizontally into liquid storage container receptacle 562 through opening 560. Further, the dispenser of FIG. 33 would normally be provided with insulation in appropriate locations similarly as described for prior embodiments.

With the liquid dispenser shown in FIGS. 33-35, the liquid storage container 500 is inserted horizontally into liquid storage container receptacle 562 in the orientation shown so that liquid storage container spout 576, when positioned to extend from liquid storage container 500, will extend through the front opening 560 of the liquid storage container receptacle 562 at the bottom front of liquid storage container 500 and through opening 578 in front door 580 hinged to front plate 558 so as to open and close opening 560 to liquid storage container receptacle 562. A sliding spout lock 582 is mounted for vertical sliding movement in slots 584, FIG. 35, in front door 580 so that in up position, FIG. 34, front door opening 578 is opened to accept spout 576 as front door 580 is opened or closed over spout 576, i.e., with spout lock 582 held in up position, front door 580 can be opened and closed without interference from spout 576. With front door 580 in closed position, FIG. 35, spout lock 582 slides downwardly so that spout receiving groove 586 in spout lock 582 will receive and lock spout 580 in place. In this orientation of liquid storage container 500, liquid storage container thermal conduction window 508 is positioned adjacent side thermal conduction pad plate 572 and in thermal conductive relationship therewith and liquid storage container thermal conduction window 509 is positioned over and adjacent and in thermal conduction relationship therewith, see FIG. 35. Since thermal conduction pad plate 570 is positioned in or on shelf 556, which forms the bottom of liquid storage container receptacle 562, thermal conduction window 509 is positioned over such thermal conduction pad plate 570 so that liquid storage container 500, and thermal conduction window 509 therein, are held by gravity in good thermal conduction relationship therewith.

Dispenser front door 580 may also include a transparent window 588 to expose a portion of the end of liquid storage container 500 therethrough. Liquid storage container 500 may be provided with a label or printed indication 590 identifying the contents of the box thereon. In this way, if such label 590 is provided on the box, a user of the dispenser can easily determine the beverage contained in the dispenser.

The countertop dispenser can be provided with an overflow or drip catch basin such as shown by 596 in FIGS. 33, 34, and 35.

Bag-in-box liquid storage containers may have a manufacturing tolerance which allows the size of the outer box to vary over as much as about one-quarter of an inch. For use with bag-in-box containers, or other containers having such loose tolerances, the liquid storage container receptacle has to be made large enough to accept the largest expected container. This means that in some cases the container will have some play in the receptacle. The best thermal conduction relationship between the dispenser thermal conduction pad and the liquid storage container thermal conduction window is when the two are in substantially direct contact. Therefore, where the size of the liquid storage container can vary with a relatively loose tolerance, it can be beneficial to include a means in the dispenser liquid storage container receptacle to provide better thermal conductive relationship between the dispenser thermal conduction pad and the liquid storage container thermal conduction window. An example of such a means is shown in FIG. 33, wherein liquid storage container receptacle side wall 574, rather than being secured in stationary position, is shown as being spring mounted, such as by springs 592, so that receptacle side wall 574 is biased toward the opposite receptacle side wall formed by thermal conduction pad plate 572. The biasing of side wall 574 toward thermal conduction pad plate 572 will result in biasing a liquid storage container received in the liquid storage container receptacle 562 laterally toward and against thermal conduction pad plate 572. The forward edge 594 of side wall 574 is angled outwardly so that a liquid storage container, such as liquid storage container 500, FIGS. 28 and 34, being inserted into the liquid storage container receptacle 562 will contact this forward edge 594 of side wall 574 as it enters the receptacle and push side wall 574 outwardly against the bias of springs 592. When the liquid storage container is in inserted position in the liquid storage container receptacle 562 as shown in FIG. 35, the liquid storage container 500 is biased against thermal conduction pad plate 572 to ensure that liquid storage container 500 and thermal conduction window 508 therein are in direct thermal conductive relationship with thermal conduction pad plate 572.

Figure 36:
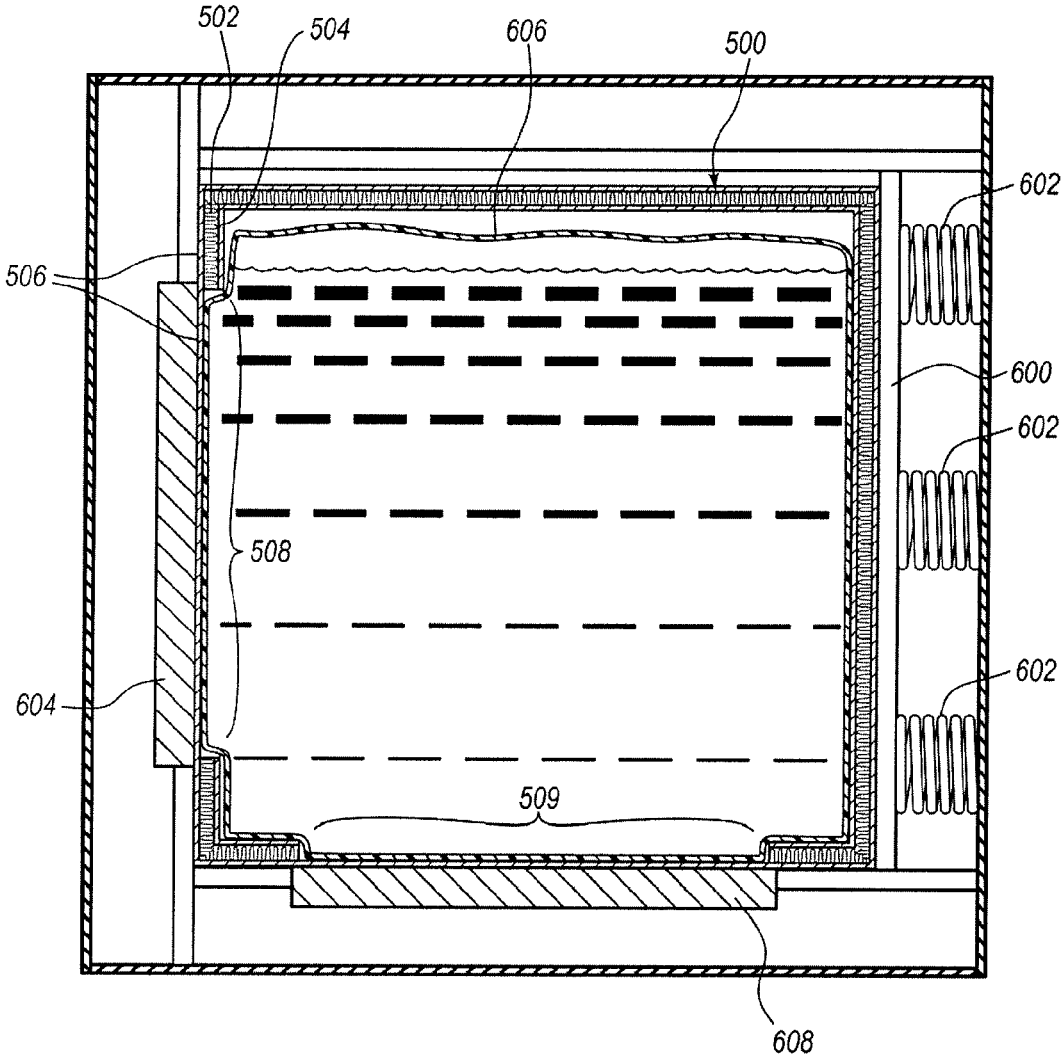
FIG. 36 is a vertical section through a portion of a dispenser similar to the dispenser of FIGS. 33-35 with the liquid storage container of FIG. 28 inserted therein an showing a biasing mechanism.

FIG. 36 is a vertical section of the bias arrangement of FIG. 33, but with a simplified more schematic dispenser structure. A side wall 600 is biased by springs 602 toward stationary thermal conduction pad plate 604. Bag-in-box liquid storage container 500 is biased by side wall 600 against thermal conduction pad plate 604 to provide a good thermal conductive relationship between thermal conduction pad plate 604 and thermal conduction window 508 in liquid storage container 500. As can be seen in FIG. 36, good thermal conduction can occur between thermal conduction pad plate 604 and liquid contained in bag 606 of bag-in-box container 500 through the sheet of paperboard, such as a preprinted paperboard, forming the outer linerboard 506 of the corrugated box material and through the material forming the bag 606. As previously indicated, inner liner board 504 and fluted corrugated medium 502 have been cut out to form thermal transfer window 508, with paperboard 506 forming a cover over the opening formed by the cutout material. Bag 606 bulges through the opening to rest against paperboard 506. Thermal conduction window 509 rests by gravity on thermal conduction pad plate 608 with similarly good thermal conduction between thermal conduction pad plate 608 and the liquid in bag 606 through the sheet of paperboard forming the outer linerboard 506 of the corrugated box material and through the material forming the bag 606. Again, inner liner board 504 and fluted corrugated medium 502 have been cut out to form thermal transfer window 509, with paperboard 506 forming a cover over the opening formed by the cutout material.

Figure 37:
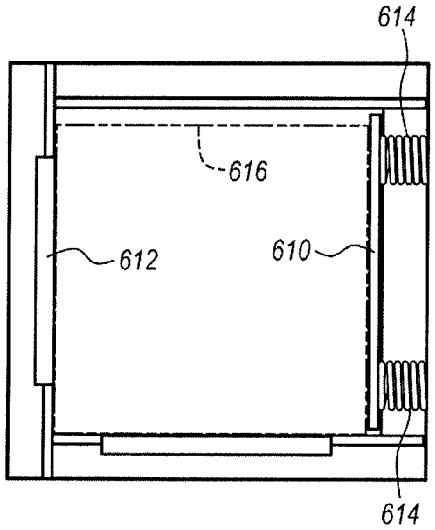
FIG. 37 is a more schematic view of the dispenser of FIG. 36 and liquid storage container of FIG. 28 as shown in FIG. 36.
Figure 38:
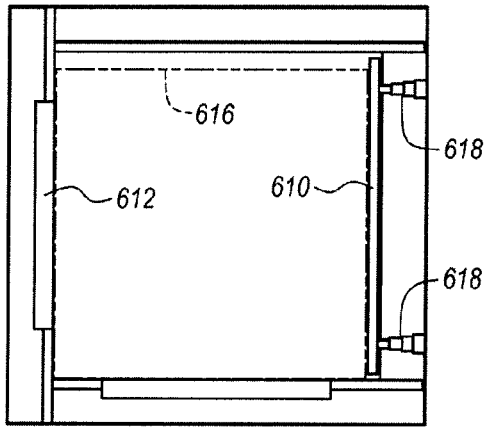
FIG. 38 is a view similar to that of FIG. 37, but showing a different embodiment of biasing mechanism.
Figure 39:
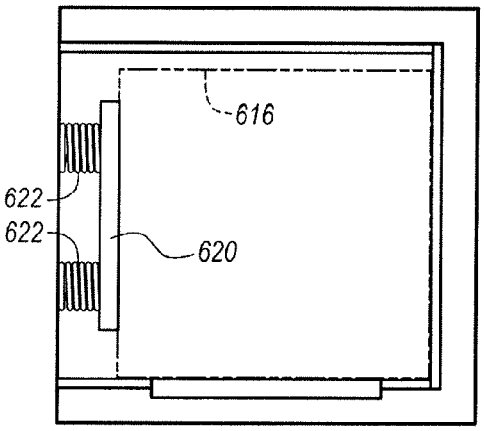
FIG. 39 is a view similar to that of FIG. 37, but showing a different embodiment of biasing mechanism.
Figure 40:
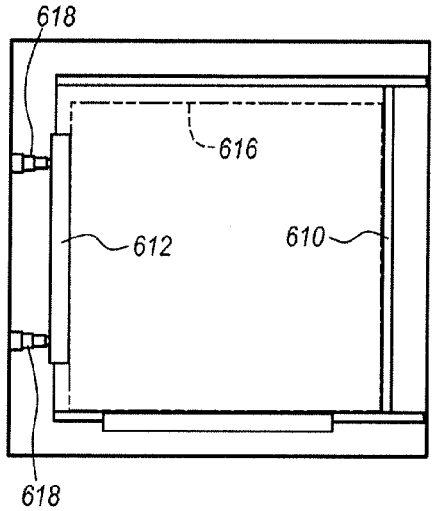
FIG. 40 is a view similar to that of FIG. 37, but showing a different embodiment of biasing mechanism.

More schematic FIGS. 37-40 are similar to FIGS. 35 and 36, with FIG. 37 showing receptacle wall 610 biased toward thermal conduction pad plate 612 by springs 614 to bias the liquid storage container 616 against thermal conduction pad plate 612. This is the same as shown in FIGS. 35 and 36. Various bias means other than springs can be used such as pneumatic or hydraulic cylinder arrangements 618 as shown in FIG. 38. Rather than biasing the receptacle wall against the liquid storage container to bias the liquid storage container against the thermal conduction pad, the thermal conduction pad can be biased against the liquid storage container. FIG. 39 shows thermal conduction pad plate 620 biased by springs 622 against liquid storage container 616. This biases liquid storage container 616 against wall 610 so that thermal conduction pad plate 620 rests against liquid storage container 616. FIG. 40 shows a similar biasing of thermal conduction pad plate 612 by pneumatic or hydraulic cylinder arrangements 618.

Figure 41:
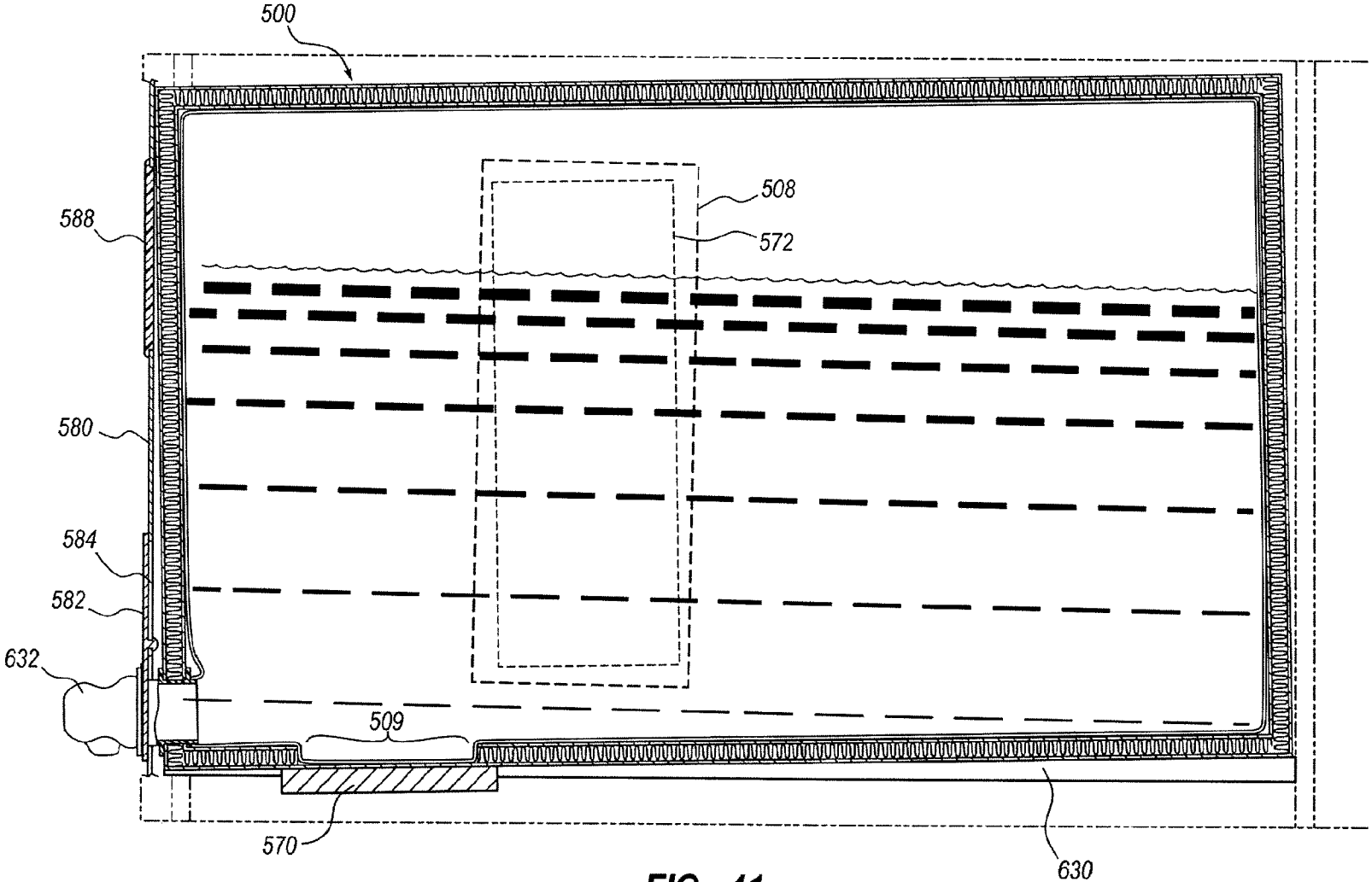
FIG. 41 is a vertical section through a liquid storage container of FIG. 28, substantially as taken on the line 42-42 of FIG. 28, in a liquid storage container receptacle of a dispenser similar to that of FIG. 33 showing a sloped receptacle floor.
Figure 42:
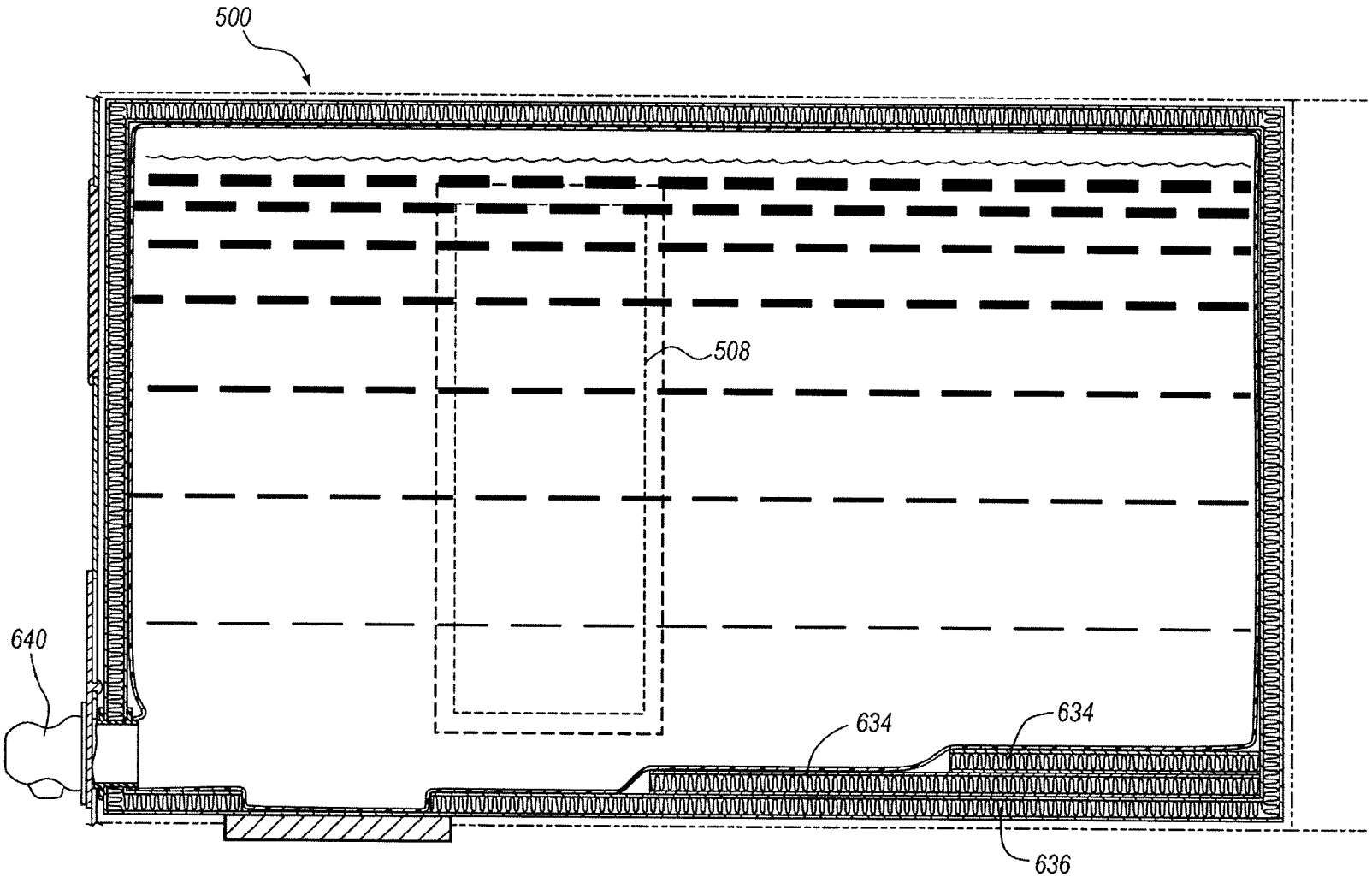
FIG. 42 is a vertical section through a liquid storage container of FIG. 28, substantially as taken on the line 42-42 of FIG. 28, in a liquid storage container receptacle of a dispenser similar to that of FIG. 33 showing an embodiment of a sloped liquid storage container bottom.

In order to reduce the amount of liquid left in the liquid storage container after dispensing liquid therefrom, it may be advantageous to slope the bottom of the storage container toward the dispensing spout in the liquid storage container. This may be done in various ways. One way is to provide a sloped floor for the liquid storage container receptacle as shown for receptacle floor 630 in FIG. 41. The slope will be oriented so that the floor is sloped downwardly toward where the liquid storage container dispensing spout 632 will be located when a liquid storage container is placed in the receptacle. With the floor 630 of the receptacle sloped, the bottom of any liquid storage container placed in the receptacle will also be sloped toward the liquid storage container dispensing spout. Rather than sloping the dispenser floor, which may interfere with loading a liquid storage container into the dispenser, the liquid dispenser itself may have a sloped or substantially sloped bottom. For example, a wedge can be placed in or built into the liquid storage container to provide a container bottom sloped toward the dispensing spout. For example, FIG. 42 shows steps formed by corrugated box material 634 placed in the bottom 636, inside of the internal storage area within the outer shell, of bag-in-box container 500 to provide a substantially sloped bottom to the bag with the slope directed downwardly toward dispensing spout 640. Steps 634 can be provided by two separate pieces of corrugated box material, or could be formed by a single piece of corrugated box material which is folded over on itself to form the steps. Various other means of forming a sloped bottom to the container, either stepped or smooth, can be used.

The present invention also provides a method for regulating the temperature of a liquid stored in a liquid storage container and dispensing the temperature regulated liquid from the storage container wherein the method includes obtaining a liquid storage container having a liquid stored therein, having at least one thermal transfer portion in the container, and having a spout for discharge of the liquid from the container. The method also includes the step of obtaining a liquid dispenser having a receptacle for receiving a liquid storage container and having a thermal conduction pad in association with the receptacle so that thermal energy can be transferred between the thermal conduction pad and a liquid storage container received in the receptacle. The method also includes the step of placing the obtained liquid storage container in the receptacle of the obtained liquid dispenser so that the thermal transfer portion of the liquid storage container is positioned in thermal conductive relationship with the thermal conduction pad associated with the receptacle. The method then includes the further step of controlling the thermal conduction pad so as to control the temperature of the liquid storage container and the liquid therein through thermal conduction between the thermal conduction pad and the liquid storage container.

When the liquid storage container is a bag-in-box container, the method of the invention includes obtaining a bag-in-box storage container having an outer box and an inner storage container and at least one thermal conduction window in the outer box for transfer of thermal energy from outside the box to the inner container. The method also includes the step of obtaining a liquid dispenser having a receptacle for receiving a liquid storage container and having a thermal conduction pad in association with the receptacle so that thermal energy can be transferred between the thermal conduction pad and a liquid storage container received in the receptacle. The method also includes the step of placing the obtained bag-in-box liquid container in the receptacle of the obtained dispenser so that the thermal conduction window of the bag-in-box liquid container is positioned in thermal conductive relationship with the thermal conduction pad associated with the receptacle. The method then includes the further step of controlling the thermal conduction pad so as to control the temperature of the inner container of the bag-in-box liquid storage container and the liquid therein through thermal conduction between the thermal conduction pad and the inner container through the thermal conduction window.

An advantage of the embodiments of the invention illustrated and described is that the dispenser of the invention controls the temperature of the liquid in the liquid storage container while the liquid remains in the liquid storage container and the temperature controlled liquid is, in most cases, dispensed directly from the liquid storage container without passing through portions, such as passages, reservoirs, and/or valves of the dispenser. This prevents contamination of the liquid from such portions of the dispenser. A new and sterile dispensing passage and valve is provided each time a new container is received in the dispenser. Further, when the dispenser is operated to cool the liquid, the cool temperature may retard bacteria growth in the liquid and liquid container. Similarly, when the liquid is maintained at a sufficiently hot temperature, the hot temperature may retard or prevent bacteria growth in the liquid and liquid container.

While the dispensers shown are designed to rest on a supporting surface such as a floor and to provide the dispensing valve at a convenient height above the floor or similar ground level supporting surface, the invention can also provide a dispenser that is sized to rest on a counter or table top and provide a dispensing valve at a convenient height for counter or table top use. It may be desirable to provide different size containers for different size dispensers. For example, a dispenser designed to be supported on a floor, such as the dispensers shown, may be sized to receive a five gallon liquid storage container in the receptacle, while a dispenser for table or counter top use may be smaller and designed to receive a smaller two and one half gallon liquid storage container or a five liter liquid storage container.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein. Further, any of the features show for the countertop embodiment can be used in the stand embodiments and any of the features used in the stand embodiments can be used in the countertop embodiment.

The invention claimed is:

1. A dispenser for dispensing a controlled temperature liquid directly from a liquid storage container to a user of the liquid, comprising:

a receptacle having bottom and side walls and adapted to receive and hold a liquid storage container of predetermined size and shape therein and to allow liquid to be dispensed by gravity from the liquid storage container when received in the receptacle;

at least one thermal conduction pad associated with the receptacle so as to be, without invading the liquid storage container, in direct thermal conductive relationship with a portion of the liquid storage container when received in the receptacle to transfer thermal energy by conduction between the thermal conduction pad and the liquid storage container and liquid contained therein;

a temperature regulation unit to control the temperature of the at least one thermal conduction pad; and mechanism for biasing the liquid storage container against one of the at least one thermal conduction pads when the liquid storage container is received in the receptacle to enhance the thermal conductive relationship of the at least one thermal conductive pad and the portion of the liquid storage container when received in the receptacle;

wherein the side walls of the receptacle include a side wall having the one of the at least one thermal conduction pads associated therewith and a side wall opposite the side wall having the one of the at least one thermal conduction pads associated therewith, and wherein the mechanism for biasing the liquid storage container against one of the at least one thermal conduction pads biases the side wall opposite the side wall having the one of the at least one thermal conduction pads associated therewith toward the side wall having the one of the at least one thermal conduction pads associated therewith to bias the liquid storage container against the side wall having the one of the at least one thermal conduction pads associated therewith.

2. A dispenser for dispensing a controlled temperature liquid directly from a liquid storage container to a user of the liquid, comprising:

a receptacle having bottom and side walls and adapted to receive and hold a liquid storage container of predetermined size and shape therein and to allow liquid to be dispensed by gravity from the liquid storage container when received in the receptacle;

at least one thermal conduction pad associated with the receptacle so as to be, without invading the liquid storage container, in direct thermal conductive relationship with a portion of the liquid storage container when received in the receptacle to transfer thermal energy by conduction between the thermal conduction pad and the liquid storage container and liquid contained therein;

a temperature regulation unit to control the temperature of the at least one thermal conduction pad; and mechanism for moving one of the at least one thermal conduction pads toward and into contact with the portion of the liquid storage container to thereby bias the one of the at least one thermal conduction pads against the portion of the liquid storage container when the liquid storage container is received in the receptacle thereby enhancing the thermal conductive relationship of the at least one thermal conductive pad and the portion of the liquid storage container when the liquid storage container is received in the receptacle.

3. A dispenser in accordance with claim 2, wherein the side walls of the receptacle include a side wall having the one of the at least one thermal conduction pads associated therewith and a side wall opposite the side wall having the one of the at least one thermal conduction pads associated therewith, and wherein the mechanism for moving the one of the at least one thermal conduction pads against the portion of the liquid storage container biases the one of the at least one thermal conduction pads against the portion of the liquid storage container when the liquid storage container is received in the receptacle.

4. A dispenser in accordance with claim 2, wherein the liquid storage container includes a bottom and a dispensing spout extending through a lower portion of the liquid storage container, and wherein the receptacle is oriented to position the liquid storage container when the liquid storage container is received in the receptacle with the bottom of the liquid storage container sloped downwardly in a direction of the dispensing spout.

5. A dispenser in accordance with claim 4, wherein the bottom of the receptacle is sloped.

6. A dispenser for dispensing a controlled temperature liquid directly from a liquid storage container to a user of the liquid, comprising:

a receptacle having bottom and side walls and adapted to receive and hold a liquid storage container of predetermined size and shape therein and to allow liquid to be dispensed by gravity from the liquid storage container when received in the receptacle;

at least one thermal conduction pad associated with the receptacle so as to be, without invading the liquid storage container, in direct thermal conductive relationship with a portion of the liquid storage container when received in the receptacle to transfer thermal energy by conduction between the thermal conduction pad and the liquid storage container and liquid contained therein;

a temperature regulation unit to control the temperature of the at least one thermal conduction pad; and means for enhancing the thermal conductive relationship of the at least one thermal conductive pad and the portion of the liquid storage container when received in the receptacle;

wherein the receptacle includes a receiving opening in one side of the receptacle to receive the liquid storage container into the receptacle, and the liquid storage container includes a dispensing spout extending through a lower portion of the liquid storage container which extends through the receiving opening when the liquid storage container is received in the receptacle, and the receptacle further includes a door to close the receiving opening, the door having a spout opening through which the spout extends when the door is closed, and a spout lock slidably mounted on the door to slide between a position to allow the door to open and close, and a position to, when the door is in closed position, hold the spout for liquid discharge.

7. A dispenser in accordance with claim 6 wherein the receptacle is oriented to position the liquid storage container when the liquid storage container is received in the receptacle with the bottom of the liquid storage container sloped downwardly in a direction of the dispensing spout.

8. A dispenser in accordance with claim 2, wherein the receptacle includes a receiving opening in one side of the receptacle to receive the liquid storage container into the receptacle with a dispensing spout extending through the receiving opening from the liquid storage container when the liquid storage container is received in the receptacle.

9. A bag-in-box storage container, comprising:

a box having an internal storage area within an outer shell, the outer shell being formed of an outer shell material having outer shell heat transfer properties and having an inner layer and an outer layer covering the inner layer;

an inner liquid storage container positioned within the internal storage area within the outer shell and in contact with the outer shell;

at least one opening in the inner layer of the outer shell to form at least one thermal conduction window in the outer shell, said opening covered by the outer layer of the outer shell, said outer layer having better heat transfer properties than said inner layer to provide greater transfer of thermal energy between the inner container and outside the outer shell through the thermal conduction window than occurs through the outer shell.

10. A bag-in-box storage container in accordance with claim 9, wherein the outer shell material is corrugated box material wherein the corrugated box material includes an inner linerboard and a fluted corrugated medium forming the inner layer and an outer linerboard forming the outer layer.

11. A bag-in-box storage container in accordance with claim 10, wherein the outer linerboard includes printed material thereon.

12. A bag-in-box storage container in accordance with claim 10, wherein the opening in the inner layer is an opening through the inner linerboard and the fluted corrugated medium.

13. A bag-in-box storage container in accordance with claim 9, wherein the inner liquid storage container is a flexible bag.

14. A bag-in-box storage container in accordance with claim 9, wherein the outer shell has a bottom, wherein the bag-in-box container includes a dispensing spout extending from the inner liquid storage container adjacent the bottom of the outer shell, and wherein the bottom of the outer shell within the internal storage area within an outer shell is configured to slope downwardly toward the dispensing spout.

15. A bag-in-box storage container in accordance with claim 14, wherein the bottom of the internal storage area within the outer shell is substantially wedge shaped.

16. A bag-in-box storage container in accordance with claim 15, wherein the substantially wedge shape in the bottom of the internal storage area within the outer shell is formed by steps.

17. A dispenser in accordance with claim 1, wherein the liquid storage container includes a bottom and a dispensing spout extending through a lower portion of the liquid storage container, and wherein the receptacle is oriented to position the liquid storage container when the liquid storage container is received in the receptacle with the bottom of the liquid storage container sloped downwardly in a direction of the dispensing spout.

18. A dispenser in accordance with claim 17, wherein the bottom of the receptacle is sloped.

19. A dispenser in accordance with claim 1, wherein the receptacle includes a receiving opening in one side of the receptacle to receive the liquid storage container into the receptacle with a dispensing spout extending through the receiving opening from the liquid storage container when the liquid storage container is received in the receptacle.

* * * * *